US005123325A

United States Patent [19]

Turner

[11] Patent Number: 5,123,325

[45] Date of Patent: Jun. 23, 1992

[54] FILM PIEZOELECTRIC PICKUP FOR STRINGED MUSICAL INSTRUMENTS

[76] Inventor: Robert A. Turner, 209 Bassett St., Petaluma, Calif. 94952

[21] Appl. No.: 681,116

[22] Filed: Apr. 5, 1991

[51] Int. Cl.[5] ..... G10H 3/18

[52] U.S. Cl. ..... 84/731; 84/730; 84/DIG. 24

[58] Field of Search ..... 84/723, 725, 726, 730, 84/731, 742, DIG. 24

[56] References Cited

U.S. PATENT DOCUMENTS

| | | | |
|---|---|---|---|
| 3,325,580 | 6/1967 | Barcus et al. . | |
| 3,624,264 | 11/1971 | Lazarus . | |
| 4,278,000 | 7/1981 | Saito et al. | 84/DIG. 24 |
| 4,314,495 | 2/1982 | Baggs . | |
| 4,491,051 | 1/1985 | Barcus . | |
| 4,727,634 | 3/1988 | Fishman . | |
| 4,774,867 | 10/1988 | Fishman . | |
| 4,904,222 | 2/1990 | Gastgeb et al. | 84/DIG. 24 |
| 4,944,209 | 7/1990 | Fishman . | |
| 5,029,375 | 7/1991 | Fishman | 84/DIG. 24 |

OTHER PUBLICATIONS

KYNAR Piezo Film Technical Manual (Penwalt Corporation, 1987), p. 43.

KYNAR Piezo Film News, No. 1 (Pennwalt Corporation, 1987), p. 4.

*Primary Examiner*—William M. Shoop, Jr.
*Assistant Examiner*—Helen Kim
*Attorney, Agent, or Firm*—Ian Hardcastle

[57] ABSTRACT

An electro-mechanical pickup for a stringed musical instrument, such as a guitar, fits in the bottom of the saddle slot of the instrument and provides an electrical output signal representing the vibrations of the strings of the instrument. The electrical output of the transducer is generated by a piezoelectric transducer element having an long, narrow piece of piezoelectric film with an electrode on each face. One electrode of the piezoelectric transducer element is attached to the conductive face of an elongated core. One conductor of a two-conductor electrical output lead is also attached to the conductive face of the core. The core provides electrical contact and a strong mechanical attachment for the output lead. A conductive contact strip is attached to the second electrode of the piezoelectric transducer element, and the second conductor of the output lead is attached to the contact strip.

In a variation of the pickup, the second electrode covers substantially all of one face of the transducer element, and the piezoelectric transducer element is wrapped completely around the core with its first electrode attached to the conductive face of the core. Wrapping the transducer element around the core enables the insulating piezoelectric film to provide insulation for the pickup, and enables the second electrode to provide electrical shielding for the pickup, which saves using additional components to provide insulation and shielding.

Further variations provide additional electrical output signals, and include an additional piezoelectric transducer element connected to reduce top noise.

36 Claims, 18 Drawing Sheets

UPPER

3 LAYER - MIDDLE

3 LAYER - LOWER

FILM PIEZOELECTRIC PICKUP FOR STRINGED MUSICAL INSTRUMENTS

BACKGROUND OF THE INVENTION

The invention concerns electrical pickups for acoustic guitars. Acoustic guitars, which are the traditional form of guitar, produce a significant output of direct sound energy, largely due to the ability of the body of the guitar to pick up and amplify the vibrations of the strings. As a result of this mechanism, the body contributes considerably to the tonal quality of the sound produced by the guitar. Acoustic guitars produce sufficient direct sound output for them to be usable without amplification when played in small rooms in front of small audiences. To be heard in larger auditoriums, amplification is necessary. For amplification to be used, some means for picking up the sound output of the guitar must also be used.

Electrical pickups for acoustic guitars must be distinguished from electrical pickups for electric guitars, because the primary mechanism by which each kind of guitar produces sound is quite different. Electric guitars produce sound by using one or more electric coils to pick up the vibration of the strings (which must be of a magnetic material, normally steel) in a magnetic field. The electrical output of the coils is then amplified and the amplified signal is then reproduced by means of a loudspeaker. Electric guitars produce relatively little direct sound energy themselves, and are totally reliant on amplification if they are to be heard by more than only the player. Unlike the body of an acoustic guitar, the body of an electric guitar contributes little to the direct sound energy output and to the tonal quality of the sound produced by the loudspeaker.

The conventional approach to picking up the sound on an acoustic guitar is to use a microphone mounted on a stand and directed towards the top of the guitar. Using a microphone works quite well for solo or small ensemble performances of classical music, but presents at least three problems in performances of more popular music: (1) it seriously restricts the player's ability to move around during the performance; (2) it may pick up too much noise from the action of the player's fingers and hands on the strings and top of the guitar (such noise will be called "top noise"); (3) it may pick up its own amplified output, leading to acoustic feedback problems; and (4), when the player shares the stage with loud instruments such as drums, keyboards, and electric guitars and basses, it may present severe problems in achieving the desired sound balance because the acoustic guitar microphone picks up sounds from these other sources in addition to the acoustic guitar. As a result of these problems, there has for a number of years been a tendency towards using self-contained acoustic guitar pickups which allow the acoustic guitar itself to produce an electrical output signal, which is then fed by a long cable, or a radio-frequency or infra-red transmitter/receiver arrangement to suitable amplification and loudspeaker equipment. Such a self-contained pickup arrangement immediately solves problem 1, and, properly designed, can solve problems 2 and 3.

Because it is desirable not to use steel strings on acoustic guitars, and acoustic guitars therefore lack the fundamental mechanical-to-electrical transducer mechanism of the electric guitar, the considerable amount of art relating to electric guitar pickups is not applicable to acoustic guitar pickups.

Basic requirements for a self-contained acoustic guitar pickup can be stated as follows: (1) the pickup must convert the mechanical vibrations of the guitar strings and body into an electrical signal; (2) the pickup must pick up some top noise, but top noise pick up should not be excessive; (3) the pickup should pick up the sound of the guitar without adding colorations of its own; (4) the pickup (together with any amplification required) should have a high electrical signal-to-noise ratio; (5) the pickup should not pick up hum, buzz and other externally induced noise; (6) the pickup should pick up the output of each string more-or-less equally; (7) it should be easy to install the pickup in the guitar, and should require a minimum of modifications to be made to the guitar itself. Some acoustic guitars are valuable antiques, the value of which can be reduced if extensive machining operations are required to accommodate a pickup; and (8) it should be easy to remove the pickup and restore the guitar to pickup-less operation.

A number of acoustic guitar pickups are already commerically available. The FRAP pickup, described in U.S. Pat. No. 3,624,264 uses three ceramic or crystalline piezoelectric transducers orthogonally mounted on three of the walls of a small box-shaped enclosure which is filled with silicone rubber. The pickup is simply attached to the body of the guitar by means of a wax or other suitable adhesive. The transducers are arranged so that one transducer detects motion along the x axis, another detects motion along the y-axis, and the third detects motion along the z-axis. The outputs of the transducers are fed in parallel into a buffer amplifier. This pickup meets requirements (1) through (3), (6), and (7) stated above. However, it is very expensive; its electrical output is low, so it suffers from signal-to-noise ratio problems; and its ability to pick up equally from all of the strings is dependent on where it is mounted on the guitar. It is often mounted under the bridge towards the end of the bridge over which the higher pitched strings pass, so tends to pick up predominantly from the higher pitched strings. This disadvantage can be overcome by using two pickups, one mounted towards each end of the bridge. This has the further advantage of offering stereo operation but at the expense of doubling the already high cost of the pickup.

Another approach is that of Baggs, described in U.S. Pat. No. 4,314,495, which is a combination piezoelectric transducer and saddle. The saddle is a component of the bridge of an acoustic guitar; it is the part of the bridge on which the strings rest. Practical embodiments of the Baggs pickup differ somewhat from the configuration described in the patent. Practical embodiments use six series-connected ceramic or crystalline piezoelectric transducers, one for each string, encapsulated in epoxy resin in a brass U-shaped channel transducer housing. The transducer housing is an integral part of a saddle formed using a fibre/resin material such as that sold under the trademark Micarta. The channel construction of the transducer housing together with the suspension of the piezoelectric transducers in epoxy resin, is thought to reduce top noise (Requirement 2 is met).

Replacing an existing saddle with a Baggs pickup is not simple, however. First, most guitar saddles are 3/32" (2.4 mm) wide (i.e., in the direction of the strings running over the saddle): the Baggs pickup is ⅛" (3.2 mm) wide, so to install it, the saddle slot in the bridge must be routed out (widened) to accommodate the pickup. Moreover, pickup is longer than a standard saddle: a further routing operation is required to lengthen the saddle slot by 1/16" (1.6 mm) to accommodate the pickup. Thus, requirement (6) is not met. The changes to the saddle slot mean that if the pickup is removed, it must be replaced by a non-standard, wider than normal, saddle. Thus, requirement (7) is not met. Moreover, since the pickup includes a completely new saddle, the guitar must be re-intonated when the pickup is installed. Finally, the brass insert in the Baggs pickup makes it more rigid than a normal saddle in the direction transverse to the direction of the strings. This means that the top of the guitar flexes differently when tension is applied to the strings, which changes the action of the guitar. More adjustment to the shape of the saddle may therefore be necessary to restore the action to normal. This pickup is also relatively short lived: the plastic saddle wears considerably more quickly than a conventional bone saddle and, when the saddle wears out, the whole pickup must be replaced. Bone cannot be substituted for plastic because it does not have appropriate directional characteristics (see below). The plastic saddle also tends to break off the brass transducer housing. Each time the pickup is replaced, the guitar must be re-intonated, which is an inconvenience.

The Baggs pickup also has some inconvenient electrical properties. The plastic material of the saddle transmits vibrations in the direction from the string to the body more efficiently than in a transverse direction. This means that the transducer mounted under each string picks up vibrations from its own string much more efficiently than it picks up vibrations from adjacent strings. This property of the plastic material enables the transducers under the A and D strings to be connected out of phase with the transducers under the other four strings. This arrangement effectively reduces top noise, top noise being transmitted to the six transducers more or less equally, but causes phasing problems when the electrical output of the guitar is mixed with any signal that might include a component representing the acoustic output of the guitar.

The Fishman pickup, is described in U.S. Pat. No. 4,727,634, U.S. Pat. No. 4,774,867, and U.S. Pat. No. 4,944,634. This pickup uses six small (1/16" dia.×0.02,"1.6 mm dia.×0.5 mm) cylindrical ceramic piezoelectric transducers, one for each string. The finished pickup is narrow enough to fit in a standard ⅛" (3.2 mm) saddle slot. The pickup is mounted in the guitar simply by removing the saddle, removing about 1/16" (1.6 mm) from the height of the saddle, drilling a hole in the top at one end of the saddle slot for the pickup output lead, and placing the pickup followed by the saddle in the saddle slot. This pickup is therefore easy to install, but suffers from the general defects of pickups based on ceramic or crystalline piezoelectric transducers discussed below. Moreover, the pickup is quite complex, since it requires separate components to mount the individual transducers resiliently, to interconnect them, and to shield them from outside interference.

All acoustic guitar pickups based on ceramic or crystalline piezoelectric transducers suffer from a number of common problems: (1) such transducers have mechanical resonances in the audio frequency range that colour the sound of the guitar; (2) the mechanical mountings of such transducers have their own mechanical resonances in the audio frequency range that further colour the sound of the guitar; and (3) such transducers are small and are thus awkward to handle in such assembly operations as attaching wires to them, etc.

A new form of piezoelectric material, a polarized homopolymer of vinylidene fluoride (PVDF) has recently become available. This material is sold under the trademark "KYNAR." Full information about this material can be found in the KYNAR Piezo Film Technical Manual (Pennwalt Corporation, 1987). This piezoelectric material is a plastic film which is available in a number of thicknesses (e.g., 28, 52, 110 microns). PVDF film has a number of properties that make it advantageous for use in acoustic guitar pickups: it has a high output voltage for a given mechanical stress; it has a low mass and a low Q, which means that it responds instantly to a mechanical input, and introduces little coloration of the sound.

Electrical contacts can be made to the material itself simply by painting a suitable lead pattern with a conductive paint, or, preferably for mass-producing, silk-screening a suitable lead pattern with a conductive ink. Attaching leads to the lead pattern presents problems, however, because of the material's low softening point and low resistance to tearing. The manufacturer suggests that a low-temperature solder can be used. This enables a reliable electrical contact to be made, but does not solve the mechanical strength problems, however.

The use of PVDF film as an acoustic guitar pickup is described at page 43 of the KYNAR Technical Manual. A piece of 28 micron thick film, about 3" by 1" is metallized on both sides. It is electrically shielded on both sides by means of a metallic foil and mechanically protected by a layer of a flexible plastic laminate. Electrical contacts are made (somehow) to the metallization on each side of the film. The complete transducer is attached to the top of the guitar, close to the sound-hole, using double-sided adhesive tape, and oriented with its long axis running in the direction of the strings so that pickup of finger noise is reduced. This type of pickup tends to pick up strings that are closer to the pickup more efficiently than strings that are more distant. The pickup placement suggested in the Technical Manual would therefore tend to give a bass-heavy output. This problem could be partially solved by using two pickups, one at each end of the bridge, in a "stereo" arrangement.

A practical embodiment of this pickup solves the lead attachment problem by using sprung mechanical contacts to pick up the electrical output of the transducer. This results in a bulky arrangement, compared with the rest of the pickup, the contact device being about 1.2×1.2×0.2 inches (30×30×5 mm).

An alternative form of acoustic guitar pickup using PVDF film is described in Kynar Piezo Film News, No. 1 (Pennwalt Corp., 1987) at page 4. The sides and bottom of standard-sized saddle are partially wrapped with a piece of transducer material about 2.8×0.7 inches (71×18 mm). The long sides of the transducer material are curved to match the curvature of the top of the saddle. The material is metallized completely on the outside and metallized in six segments, one for each string, on the inside (i.e., the side closer to the saddle). The transducer is glued directly to the saddle. There is no mechanical protection or electrical shielding; the player's hand can induce an objectional buzz into the output of the pickup if it gets too close to the pickup. This pickup is also relatively short lived: the saddle material is not as durable as bone, the material normally used for making saddles, and the whole pickup must be replaced if the saddle wears out.

This basic assembly would install directly in a standard saddle slot without any modification were it not for the large plastic connector assembly on one end of the modified saddle. To accommodate the connector assembly, the saddle slot in the bridge must be routed out to about 0.22" (5.6 mm) for a length of about 0.3" (7.6 mm); the saddle slot must be lengthened by about 0.07" (1.8 mm); and a 0.22" (5.6 mm) diameter hole must be drilled in the top at the widened end of the saddle slot. This pickup is therefore inconvenient to install, and difficult to replace if no longer desired.

Practical embodiments of this pickup are sold as part of the Gibson TM Symbiotic Oriented Receptor System (S.O.R.S.).

SUMMARY OF THE INVENTION

The invention is a new configuration of acoustic guitar pickup using PVDF or a similar piezoelectric plastic film transducer element that can be installed in an acoustic guitar without the need to modify the standard saddle slot.

Important aspects of the invention include its extreme simplicity, involving only four component parts, and novel solutions to the problem of making compact, electrically reliable, and mechanically strong connections from electrodes on a piezoelectric transducer element to an output lead, and hence to an amplifier and loudspeaker. The connections have to be sufficiently compact to enable the pickup to be installed at the bottom of an unmodified standard saddle slot in the bridge of the guitar.

All embodiments of the invention comprise a piezoelectric transducer element, a core, a contact strip, and an output lead, which preferably has coaxial construction. The core is elongated, has a plurality of faces, at least one of which, preferably the largest, is conducting. Preferably, the core has a rectangular cross-section. In the simplest embodiment of the invention, the piezoelectric transducer element comprises a small piece of piezoelectric plastic film with a first electrode deposited on one side, and a second electrode deposited on the other side. The piezoelectric transducer element is about the same size as the conductive face of the core. The piezoelectric transducer element is attached to the core, preferably by means of a conductive adhesive, such the first electrode of the piezoelectric transducer element makes mechanical and electrical contact with a conductive face of the core. One conductor of the output lead, normally the inner conductor, is also mechanically and electrically attached to the core. In the preferred embodiment, the strength of the attachment between the output lead and the core is increased by attaching, in addition, the outer conductor of the output lead to a part of the core that is electrically isolated from the part of the core to which the inner conductor is attached. The output lead is arranged so that its long axis runs at right angles to the long axis of the core, the transducer and output lead constituting an L-shaped structure. The conductive core gives the pickup its basic mechanical strength, forms an electrical contact for the first electrode of the piezoelectric transducer element, and serves as the primary anchor of the output lead.

The other conductor of the output lead, normally the braid or outer conductor, is mechanically and electrically attached to the conductive contact strip, which preferably is a piece of conductive foil the same width as, and is slightly shorter than, the face of the core to which the first electrode of the piezoelectric transducer element is attached. The contact strip is attached, preferably by means of a conductive adhesive, to the second electrode of the piezoelectric transducer element. The contact strip forms the electrical contact to second electrode of piezoelectric transducer element and also serves as a secondary mechanical anchor of the output lead. The contact strip also distributes secondary mechanical stresses from the output lead over a wide area of the piezoelectric transducer element. The core and contact strip arrangement enables the output lead to form reliable electrical contacts with both electrodes of the piezoelectric transducer element without the physical dimensions of the transducer exceeding the physical dimensions of the saddle slot.

The simple form of the pickup suffers from two disadvantages: it requires the addition of some form of electrical shielding to prevent it from picking up hum and noise; and the bottom of the saddle cannot contact the transducer element directly: depending on which way up the pickup is mounted in the saddle slot, either the core or the contact strip is interposed between the bottom of the saddle and the transducer element.

These disadvantages are overcome in the preferred embodiment, which uses a piece of piezoelectric film considerably larger than the largest face of the core for the piezoelectric transducer element. Normally, the first electrode, in the form of a strip having substantially similar dimensions to those of the conductive face of the core, is deposited on one side of the film. The other side of the film is completely covered by the second electrode. Like the simple embodiment, the first electrode is attached to the conductive face of the core, preferably with a conductive adhesive, but, unlike the simple embodiment, the rest of the piezoelectric transducer element is wrapped around the core. The piezoelectric transducer element is preferably wrapped such that there is a double thickness of film and second electrode on the face of the core remote from the conductive face of the core. The resulting structure has essentially the same dimensions and shape as the core. It should be understood that, despite the larger piezoelectric transducer element of the preferred embodiment, the only active part of the piezoelectric transducer element that contributes to the electrical output of the pickup is that part of the piezoelectric transducer element on which the first electrode is deposited.

The extended second electrode of the piezoelectric transducer element of the preferred embodiment provides a complete electrical shield (lacking in the simple embodiment) around the core, piezoelectric film, and first electrode without the need for additional components or manufacturing steps. The extended second electrode also allows the saddle to contact the active part of the transducer element directly because the contact strip can be attached to the second electrode on the other side of the core. The larger piece of film used in the preferred embodiment is also easier to handle, and gives the pickup greater structural integrity. The film is an insulator and so provides electrical insulation for the pickup without the need for an additional insulating layer. Finally, the film is resilient: the three layers of film between the bottom of the saddle and the bottom of the saddle slot in the preferred embodiment enables the pickup to accommodate unevenness in the bottom of the saddle or the bottom of the saddle slot.

In an alternative embodiment of the piezoelectric transducer element of the preferred embodiment, the capacitance of the pickup can be increased by increasing the width of the first electrode of the piezoelectric transducer element so that it is approximately equal to the width plus twice the thickness of the core. When wrapped around the core, the first electrode of this alternative embodiment envelops the conductive face and the non-conductive sides of the core. Increasing the capacitance of the pickup increases the output of the pickup, reduces lead loss, and decreases the amplifier input impedance required to obtain a flat low-frequency response.

In a preferred embodiment, a rectangular piece of 1/32" thick doublesided fibre-glass printed circuit board material serves as the core, the two copper sides of the board forming the largest faces. A plated-through hole is located near one end of the core. Normally, all the copper is removed from one of the faces, except for a small area surrounding the plated-through hole. The plated-through hole serves as the primary anchor for the output lead. One conductor of the output lead (normally the inner conductor) is inserted into the plated-through hole and soldered in place.

Fibre-glass is less active acoustically than metal: a fibre-glass core therefore enables a pickup to be made with substantially reduced the coloration of the sound of the guitar. On the other hand, if coloration is desired for artistic reasons, then a pickup can be made with same basic structure but using a core of metal, or some other suitable material having at least one conductive surface.

The basic pickup configuration can be modified to provide a multi-channel pickup producing multiple electrical output signals, in which each electrical output signal represents the output of one or more of the strings of the guitar. In such a pickup, the first electrode is divided into a plurality of sub-electrodes; the conducting face of the core is divided into a plurality of sub-faces, one sub-face corresponding to each per sub-electrode; and there is a plurality of output lead conductors, one of which is connected to each subface. For example, a "stereo" version of the basic pickup produces two electrical signals, one electrical signal representing the output of some of the strings of the guitar (for example, the lower three strings), and the other electrical output signal represents the output of the other strings of the guitar (for example, the upper three strings). The first electrode of the single piezoelectric transducer element is divided into two sub-electrodes and the conductive face of the core is divided into two sub-faces. One variation of the "stereo" pickup uses two output leads, one connecting to each sub-face, and hence to each sub-electrode of the piezoelectric transducer element; another variation uses a single output lead with two inner conductors. In this latter variation, at least one layer of the printed circuit board used for the core is selectively etched to provide tracks for connecting the two sub-faces (and hence the two sub-electrodes of the piezoelectric transducer element) to the two inner conductors of the output lead.

An auxiliary piezoelectric transducer element having a first and a second auxiliary electrode can be wrapped within the basic pickup and its output subtractively combined with the output of the main piezoelectric transducer element to reduce top noise. In such a pickup, the first electrode of the main piezoelectric transducer element is extended to make contact with one of the auxiliary electrodes of the auxiliary transducer element. The top-noise reduction effect can be determined by the relative areas of the first electrode of the main piezoelectric transducer element and the first auxiliary electrode of the auxiliary piezoelectric transducer element.

The pickup is installed in a guitar by de-tensioning the strings, and removing the bridge saddle. A hole, about the same diameter as the width of the saddle slot (3/32" or approximately 2.4 mm), is drilled through the bridge and the top of the guitar at one end of the saddle slot. About 1/16" (1.6 mm) of material is removed from the bottom of the saddle, to reduce its height by the thickness of the transducer. The output lead is threaded through the hole, and the transducer is installed at the bottom of the saddle slot. The saddle is then re-inserted in the saddle slot, the strings are re-tensioned and the guitar re-tuned. Because the existing saddle is used, and the height of the top of the saddle above the body is the same as before the pickup was installed, there is no need to re-intonate the guitar after installing the pickup. Because the transducer is flexible, it adapts to the shape of the saddle and therefore does not change the action of the guitar.

The pickups described can also be adapted for use in other types of stringed instruments which translate the vibrations of the strings into variations of pressure.

Further details of the pickup are given in the drawings and the detailed description of the invention which follow.

DESCRIPTION OF THE DRAWINGS

FIG. 3(*b*) is a cross-sectional view of the bridge of a typical acoustic guitar taken along line A—A' in FIG. 3(*a*), showing a pickup according to the invention installed under the saddle in the saddle slot.

FIG. 3(*c*) is a cross-sectional view of the bridge of a typical acoustic guitar taken along line B—B' in FIG. 3(*a*), showing the simple embodiment of the pickup according to the invention installed under the saddle in the saddle slot, and showing a cross-sectional view of the pickup itself.

FIG. 4(*b*) is a plan view of the part of the lower face of the core to which the output lead is attached, showing the plated-through hole and the lead anchor pad.

FIG. 5(*b*) is a cross-sectional view taken along line C—C' of FIG. 5(*a*), showing how the inner conductor of the output lead is attached to the plated-through hole and the braid of the output lead is attached to the lead anchor pad.

FIG. 7(*c*) is a cross-sectional view of the piezoelectric transducer element taken along the line D—D' in FIG. 7(*a*). The figure also shows how adhesive is applied to the face of the piezoelectric transducer element.

FIG. 8(*b*) is a cross-sectional view showing the initial assembly of the piezoelectric transducer element and the core, in which the piezoelectric transducer element is wrapped around the core in a single wrapping operation.

FIG. 8(*c*) is a cross-sectional view of the core and piezoelectric transducer element assembly after the piezoelectric transducer element has been wrapped around the core before the contact strip is attached.

FIG. 8(*d*) is a cross-sectional of the core and piezoelectric transducer element assembly after the piezoelectric transducer element has been wrapped around the core and the contact strip has been attached.

FIG. 10(*b*) shows a perspective view of a two output lead "stereo" version of the pickup according to the invention.

FIG. 10(*c*) shows plan views of the upper and lower faces of the core of a two output lead "stereo" version of the pickup according to the invention.

FIG. 10(*d*) shows a plan view of the second electrode side of the piezoelectric transducer element of a two ouput lead "stereo" version of the pickup having complete electrical isolation between its two outputs.

FIG. 11(*b*) shows an exploded perspective view of the core and output lead of a single output lead "stereo" version of the pickup according to the invention.

FIG. 11(*c*) is a plan view of the upper face of the core of a single output lead "stereo" version of the pickup according to the invention FIG. 11(*d*) is a plan view of the lower face of a two conductive layer version of the core of a single output lead "stereo" version of the pickup according to the invention.

FIG. 11(*e*) is a plan view of an alternative embodiment of the lower face of a two conductive layer core of a single output lead "stereo" version of the pickup according to the invention.

FIG. 11(*f*) is a plan view of the middle layer of a three conductive layer core of a single output lead "stereo" version of the pickup according to the invention.

FIG. 11(*g*) is a plan view of the lower face of a three conductive layer core of a single output lead "stereo" version of the pickup according to the invention.

FIG. 11(*h*) is a plan view of an alternative embodiment of the lower face of a three conductive layer core of a single output lead "stereo" version of the pickup according to the invention.

FIG. 12(*b*) shows a plan of the first electrode side of the piezoelectric transducer element of a pickup including an auxiliary transducer for reducing top noise.

DETAILED DESCRIPTION OF THE INVENTION

Figure 1:
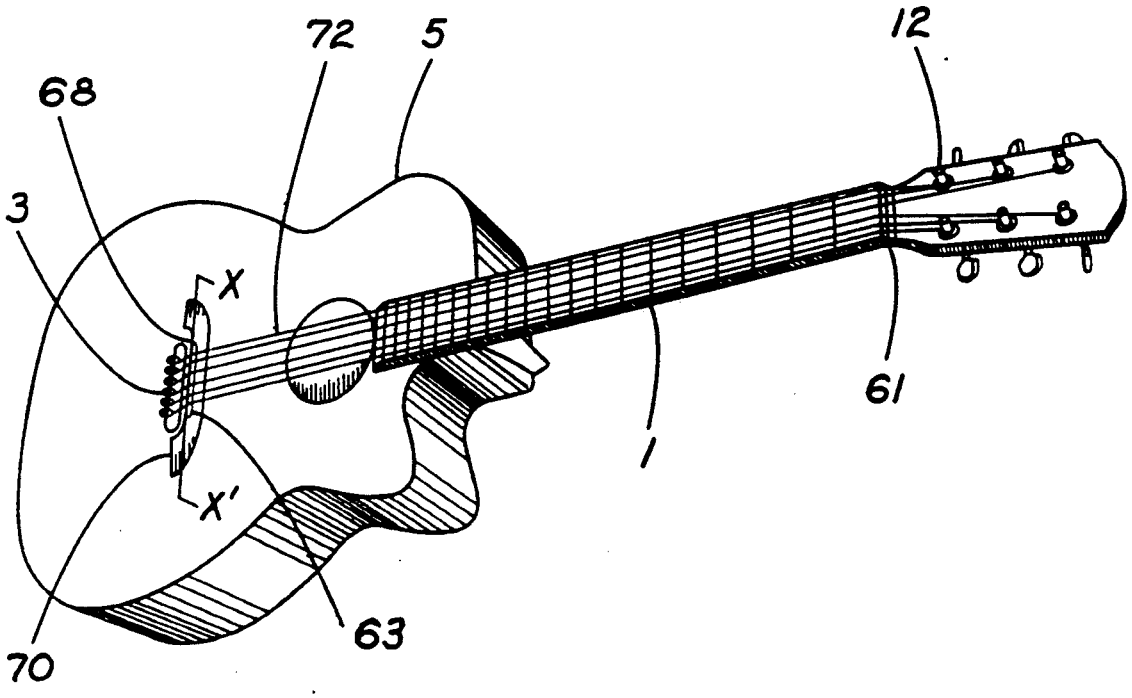
FIG. 1 PRIOR ART
FIG. 1 is a perspective view showing the main parts of a typical acoustic guitar.

The structure of a normal acoustic guitar is shown in FIG. 1. Neck 1 is attached to body 5. Strings 72 are attached to body 5 by means of anchor points 3 at one end and at the other end by tuning mechanism 12. The strings rest on saddle 63, which is mounted in saddle slot 68 in bridge 70. Saddle 63 transmits the mechanical vibrations of the strings to the body of the guitar, which causes the body of the guitar to vibrate. The vibrating body effectively couples the vibrations of the strings to the surrounding air. Saddle 63, together with nut 61, also defines the vibrational length of each string. By adjusting the precise point on the saddle at which each string makes contact with the saddle, the guitar is intonated, so that when each string is stopped at its octave fret, the note produced is at the same pitch as the second harmonic of the open string.

Figure 2:
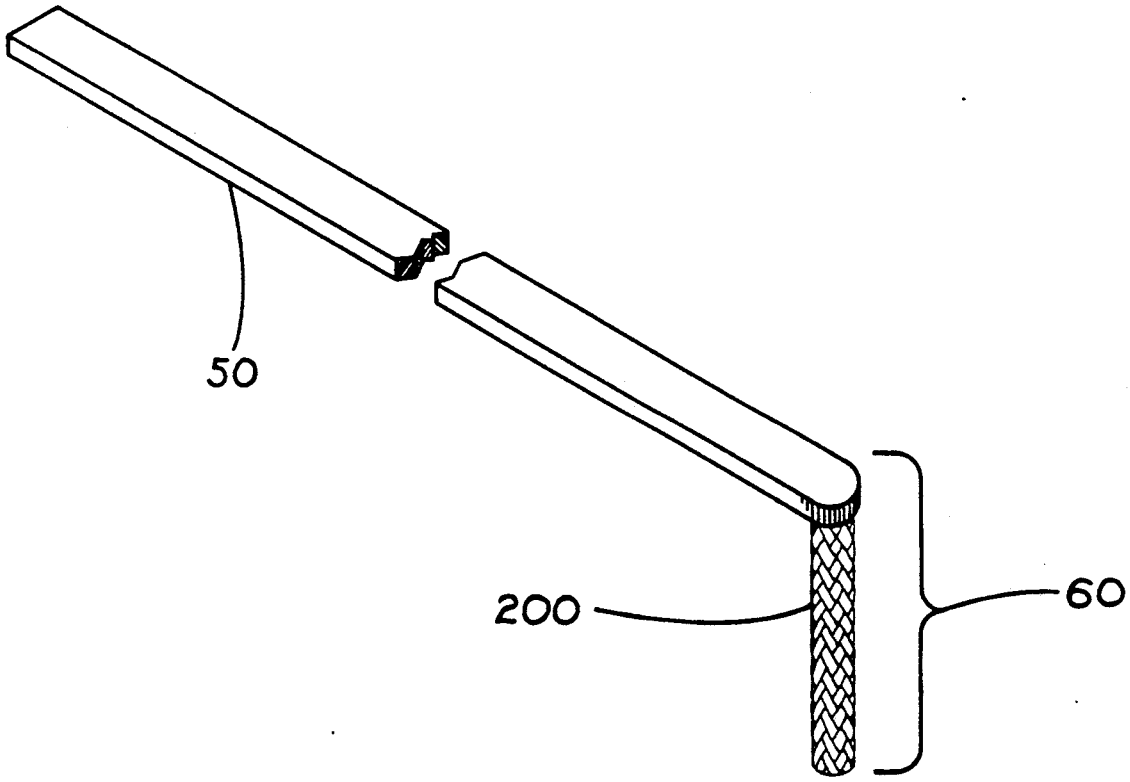
FIG. 2 is a perspective view showing an embodiment of a pickup according to the invention.

FIG. 2 shows pickup 60, comprising transducer 50 and coaxial output lead 200. Because the length of the pickup is over forty times its width, FIG. 2 and most of the other drawings showing the pickup and its components show the pickup and its components in broken form, so that details of the width and thickness of the pickup can be depicted.

Figure 3A:
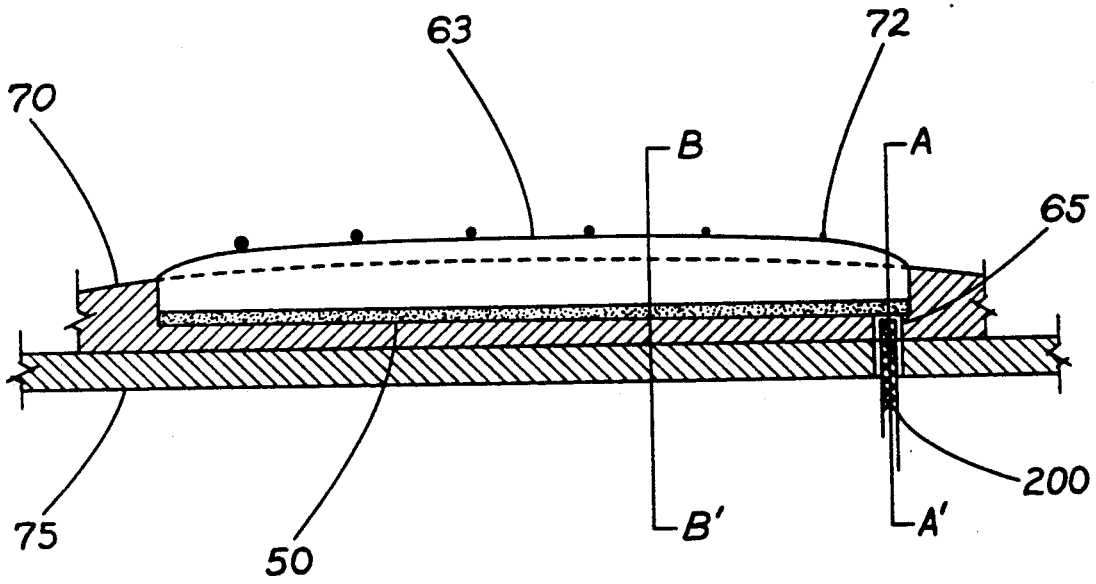
FIG. 3 (*a*) is a cross-sectional view of the bridge of a typical acoustic guitar taken along the line X—X' in FIG. 1, showing a pickup according to the invention installed under the saddle in the saddle slot.
Figure 3B:
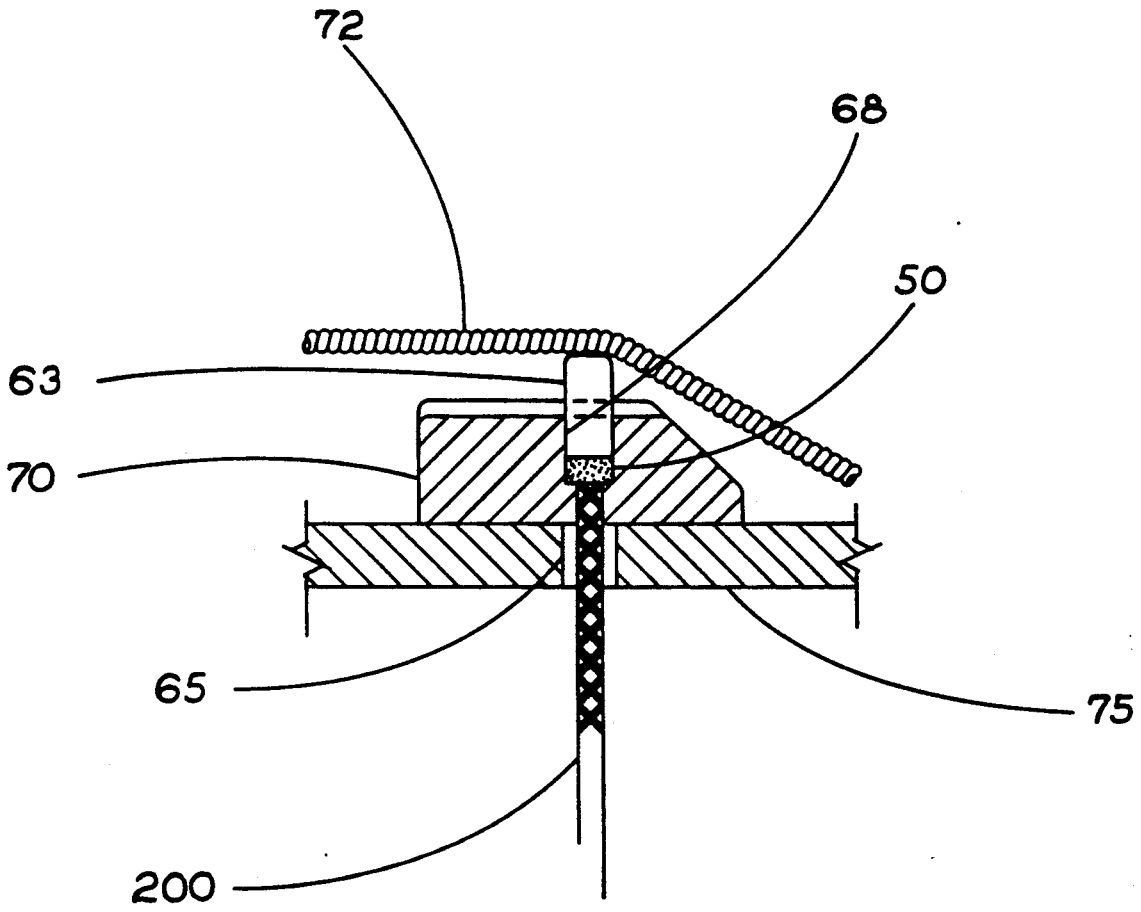
Figure 3C:
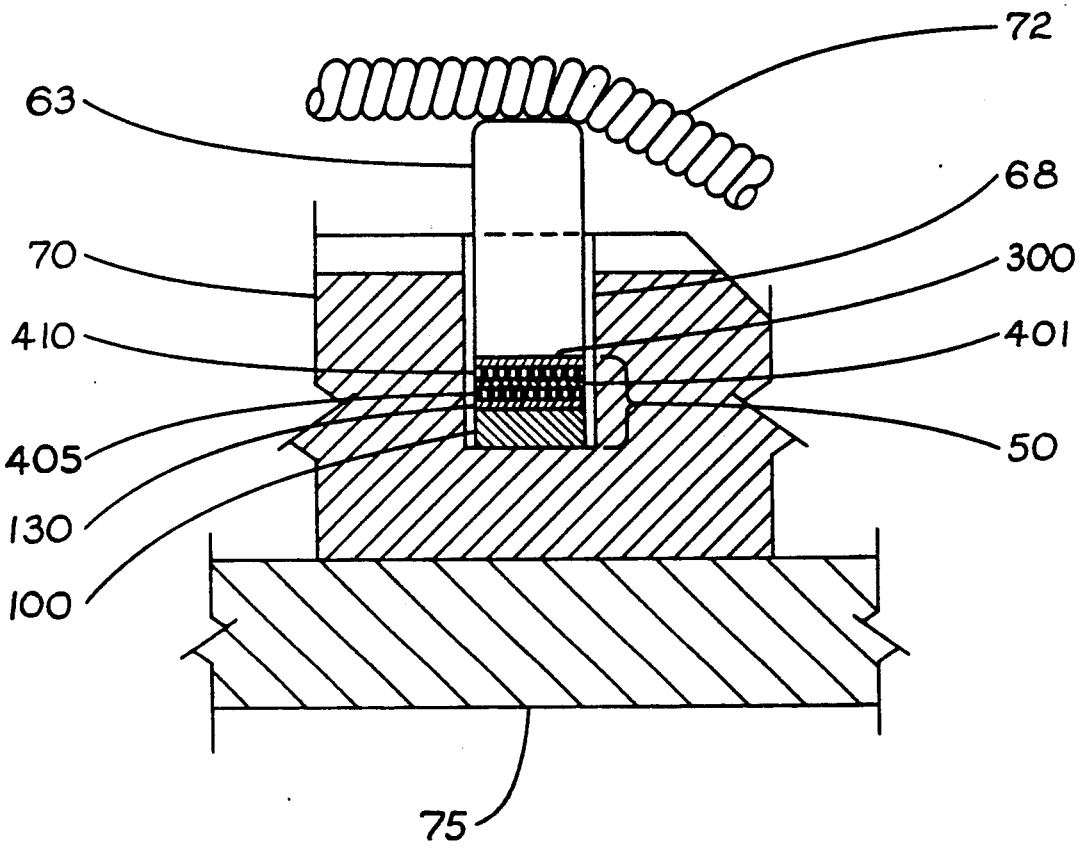

FIG. 3 shows cross-sectional views of the pickup installed in saddle-slot 68 of the bridge 70 of a guitar, the top of which is shown as 75. In FIG. 3(*c*) the simple embodiment of the pickup is also shown in cross-sectional view to illustrate the way in which the pickup converts the sound of the guitar to an electrical signal. The conversion mechanism of the active part of the preferred embodiment is the same. Transducer 50 sits at the bottom of saddle slot 68 in bridge 70 and is sandwiched between the bottom of saddle 63 and the bottom of saddle slot 68. The tension of the strings 72 exerts a force on saddle 63 in the vertical direction depicted in FIG. 3(*c*). Saddle 63 is free to move in the vertical direction, and thus exerts a static compressive load on the upper face of transducer 50. The lower face of transducer 50 in turn transmits the compressive load to bridge 70 and hence to the rest of the guitar.

The basic transducing element of transducer 50 comprises first electrode 405, the part of second electrode 410 adjacent first electrode 405, and the part of piezoelectric film 401 between first electrode 405 and second electrode 410. When the strings are tensioned, the static load on transducer 50 compresses film 401 and causes a D.C. voltage difference between electrodes 405 and 410. However, since the transducer is essentially capacitive, this D.C. voltage gradually decays to zero.

If string 72 is struck, the tension in the string varies, which varies the vertical component of the force applied to saddle 63. This causes the load applied to transducer 50 to vary. Transducer 50 transmits the varying force to bridge 70 and hence to the body of the guitar, which causes the body of the guitar to vibrate as the body of an acoustic guitar is designed to do. The vertical component of the movement of the top of the guitar applies a force to the lower face of transducer 50 via bridge 70. Transducer 50 is therefore subject to a dynamically varying compressive force, which produces an a.c. voltage difference between electrodes 405 and 410. The a.c. voltage difference between electrodes 405 and 410 represents the varying compressive force on transducer 50 due to the vibrations of the strings and the body of the guitar. This voltage thus includes components representing the vibration of the strings and the vibration of body of the guitar resulting from the vibration of the strings. The a.c. voltage difference between the electrodes produces a corresponding a.c. voltage difference between core 100 (in contact with electrode 405) and contact strip 300 (in contact with electrode 410), and hence between the conductors of output lead 200. Output lead 200 feeds the a.c. voltage difference to a suitable amplifier and loudspeaker (not shown) for reproduction.

Figure 4A:
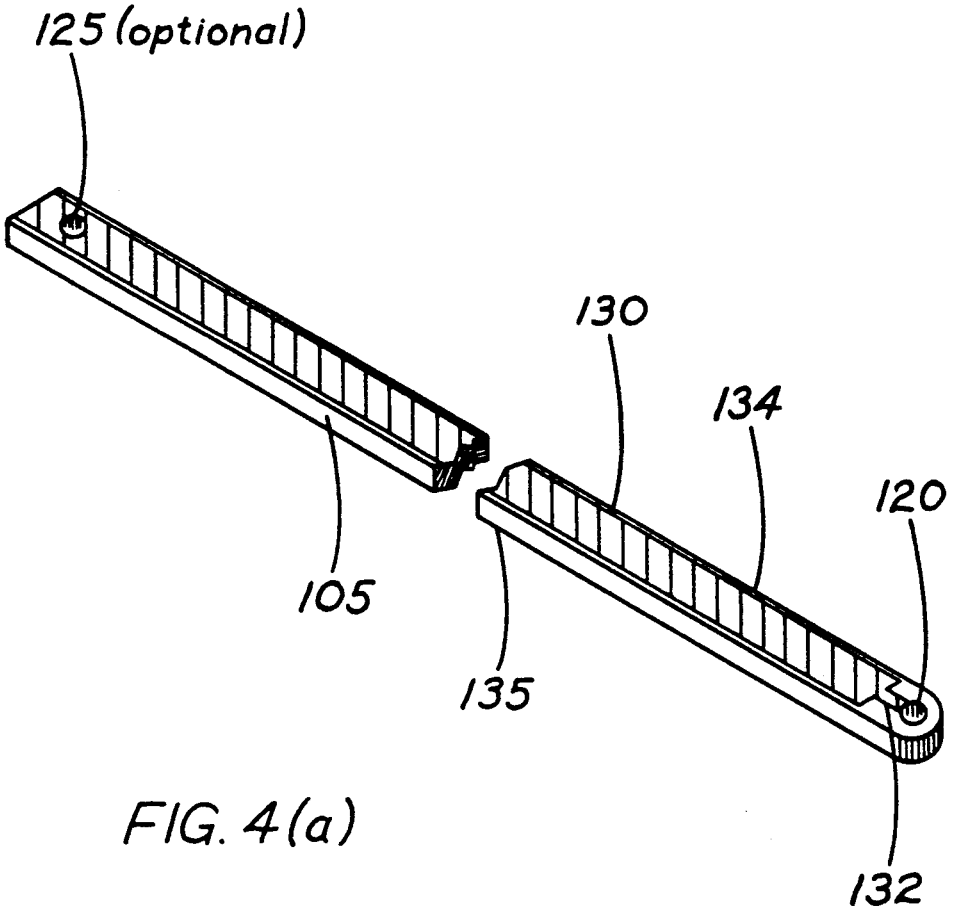
FIG. 4(*a*) is a perspective view showing mainly the upper face of the core of a pickup according to the invention.
Figure 4B:
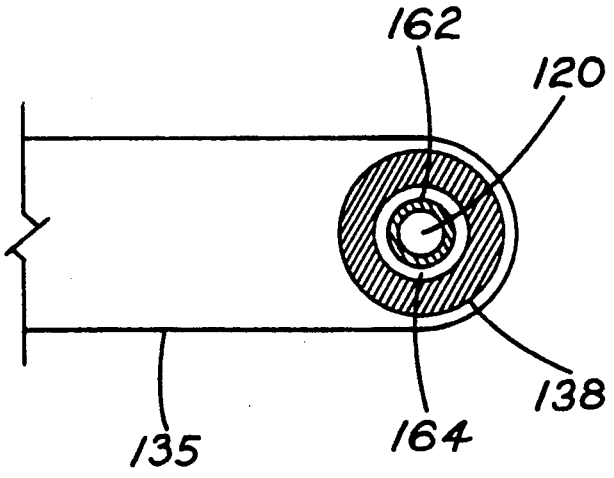

The structure of the preferred embodiment of the invention, which produces its electrical output in the same way as the simple embodiment, will now be described. The pickup comprises four basic components which will be described in turn: core 100, output lead 200, contact strip 300 and piezoelectric transducer element 400. FIG. 4 shows core 100. Core 100 is an essentially rectangular piece of 1/32" (0.8 mm) thick material, about 2.75" (70 mm) long by 1/16" (1.6 mm) wide. At least one end of core 100 is preferably rounded, as shown in FIG. 4; alternatively, one or both ends can be straight-cut. A variety of materials can be used for core 100, the main purpose of which is to support piezoelectric transducer element 400, and to anchor output lead 200. An all-metal core will serve these purposes, but, because all of its surface is conducting, it tends to pick up more unwanted interference than an insulating core with one or more conductive surfaces. This measn that an all-metal core requires more shielding than an insulating core with one or more conductive surfaces. Finally, an all-metal core colours the sound more than a plastic core: for most purposes the more neutral sound of a plastic core is desirable.

In the preferred embodiment, plastic cores with one or more conductive surfaces are cut from a sheet of fibre-glass printed circuit board 105, clad on each side with 1 ounce per square foot (0.3 kg per square meter) of copper, the overall thickness of the board being 1/32" (0.8 mm). Before the sheet of printed circuit board is cut into individual cores, the sheet is drilled with at least one 0.030" (0.75 mm) diameter hole 120 per core.

Also before the sheet of printed circuit board is cut into individual cores, copper is selectively removed from both sides of the boards to form the metallization patterns required for each core. Copper removal is preferably done by a mask and etch process well known in the art. Copper may be left on all of the conductive face 130 of each core, but it is preferred that copper be removed from a narrow strip 134 around the periphery of each core, and, in addition, that copper be removed to form a short, narrow track 132 connecting hole 120 with the rest of the conductive face 130 of the core, as shown in FIG. 4(*a*). The narrow track 123 in the vicinity of hole 120 facilitates soldering output lead 200 in hole 120.

Copper may be removed from substantially all of the other side of the printed-circuit board, to form the second face 135 of each core. A small annulus 162 of copper around each hole 120 is left on each core to facilitate plating through the hole. Removing copper from face 135 of each core electrically isolates the part of transducer element 400 in contact with face 135. This reduces top noise because face 135 is closer to the top of the guitar than to the strings when the pickup is installed in the guitar.

In the preferred embodiment, a further copper annulus, surrounding copper annulus 162 surrounding plated-through hole 120 but insulated from it, is left on each core to serve as the lead anchor pad 138 for the second conductor (normally braid 205) of output lead 200, as shown in detail in FIG. 4(*b*). The inner diameter of lead anchor pad 138 is preferably the same as the outer diameter of inner insulator 210 of output lead 200. The outer diameter of lead anchor pad 138 is preferably the same as the width of core 100, i.e., about 1/16" (1.6 mm).

Copper may be left on the other side of the board if it is desired to have some pick up from the part of transducer element 400 in contact with face 135 of the core. If copper is left on face 135 of the core, each core should also have a second plated-through hole 125 at the other end of the core from hole 120 to interconnect the two faces. Lead anchor pad 138 must be isolated from face 135 by a suitable removal of copper.

Hole 120, and, optionally hole 125, are then plated through using techniques that are well known in the printed circuit board-manufacturing art. It is also preferable that both sides of the sheet be plated with 20 $\mu$" (0.5 $\mu$m) of gold to prevent tarnishing and the formation of a rectifying contact between conductive surface 130 of core 100 and electrode 405 piezoelectric transducer element 400, and to facilitate soldering the braid of output lead 200 to lead anchor pad 138. Additionally, lead anchor pad 138 is tinned.

The sheet of printed circuit board then cut into individual cores with the above-stated dimensions. Alternatively, the sheet of printed circuit board can be cut up into individual cores before the gold plating, hole-drilling, copper removal, plating-through, and lead anchor pad tinning operations.

Single-sided printed circuit board without plated-through holes can be used for core 100, but such an arrangement is less strong, and hence is likely to be less reliable, than an arrangement with plated-through holes.

Figure 5A:
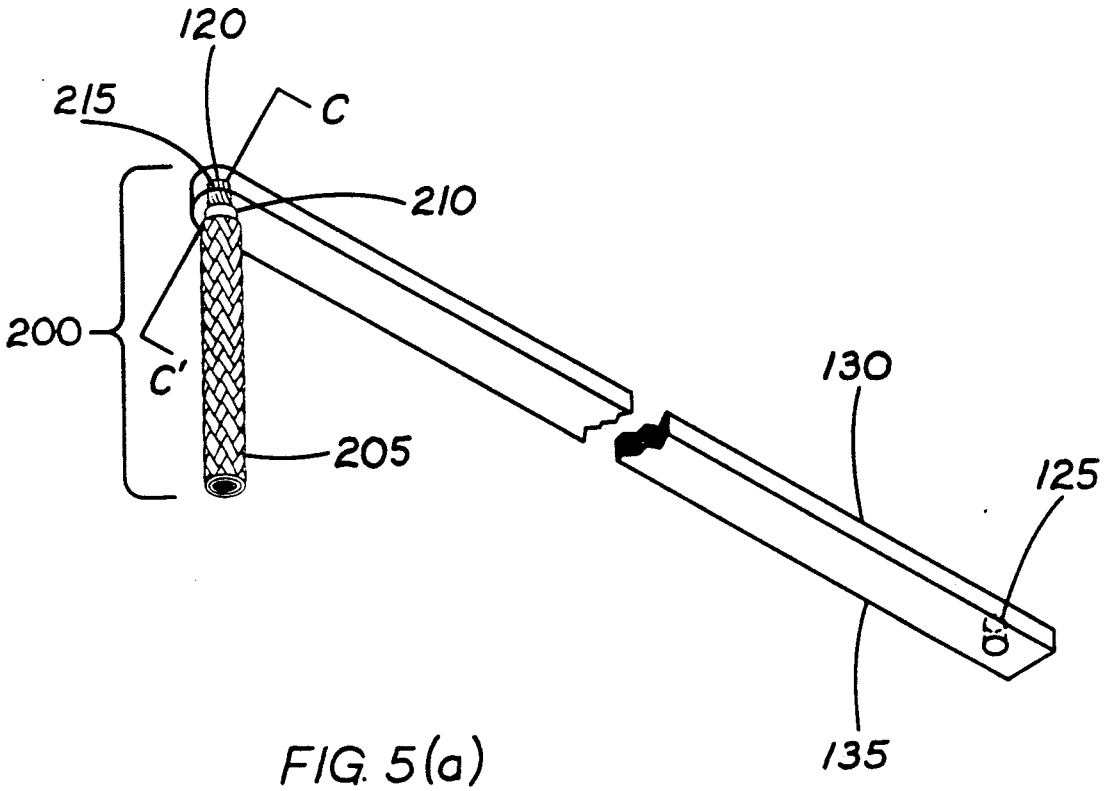
FIG. 5(*a*) is a perspective view showing the lower face of the core and how the inner conductor of the output lead is inserted into the plated-through hole in the core.
Figure 5B:
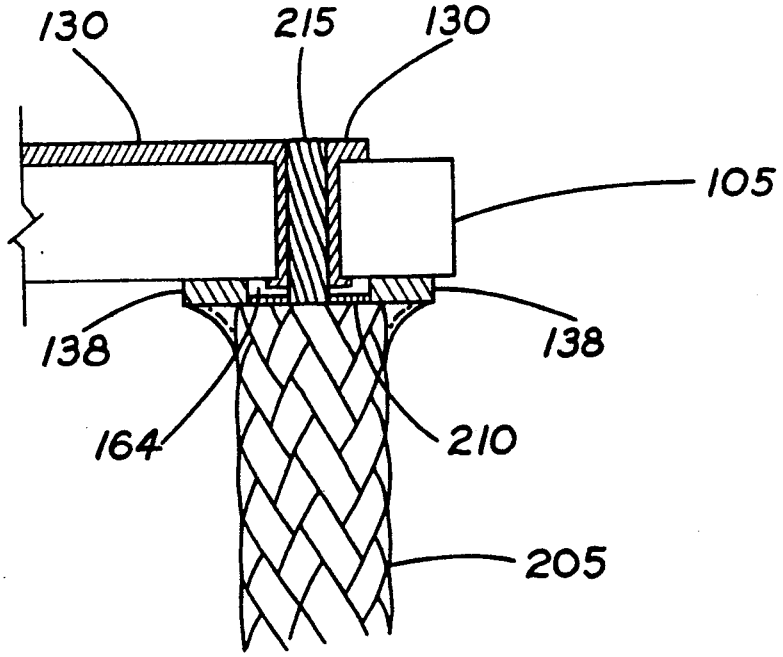
Figure 6A:
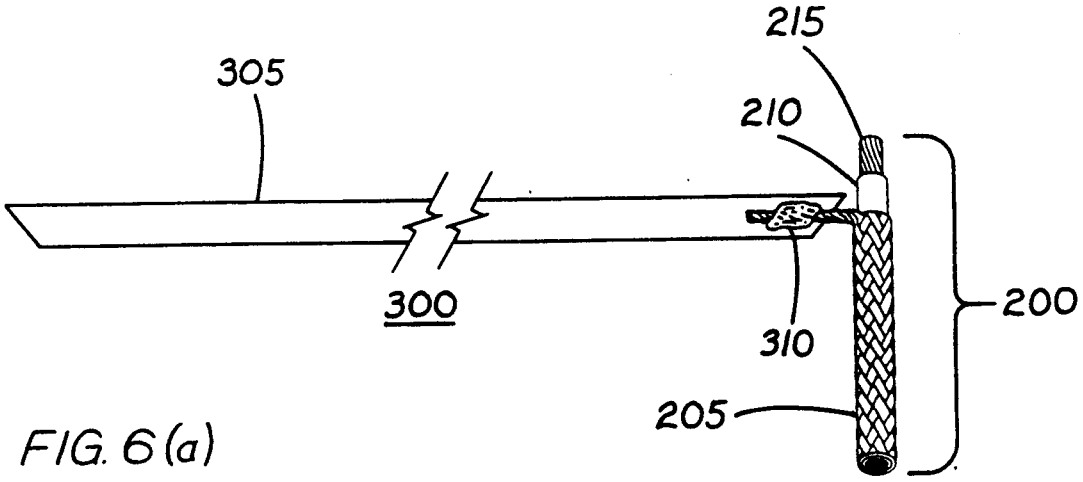
FIG. 6(*a*) through 6(*f*) are perspective views showing the output lead and the lower face of the contact strip and six different arrangements for attaching the contact strip to the braid of the output lead.
Figure 6B:
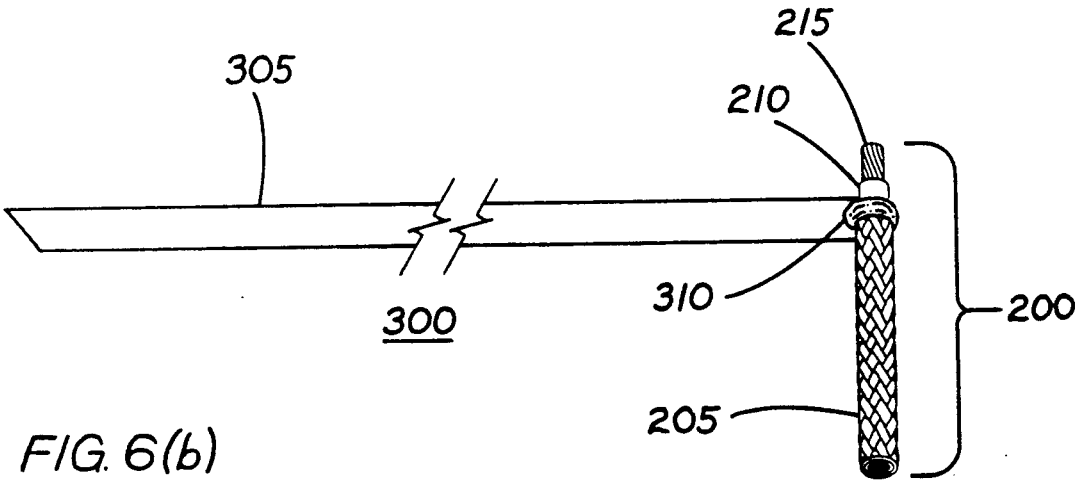
Figure 6C:
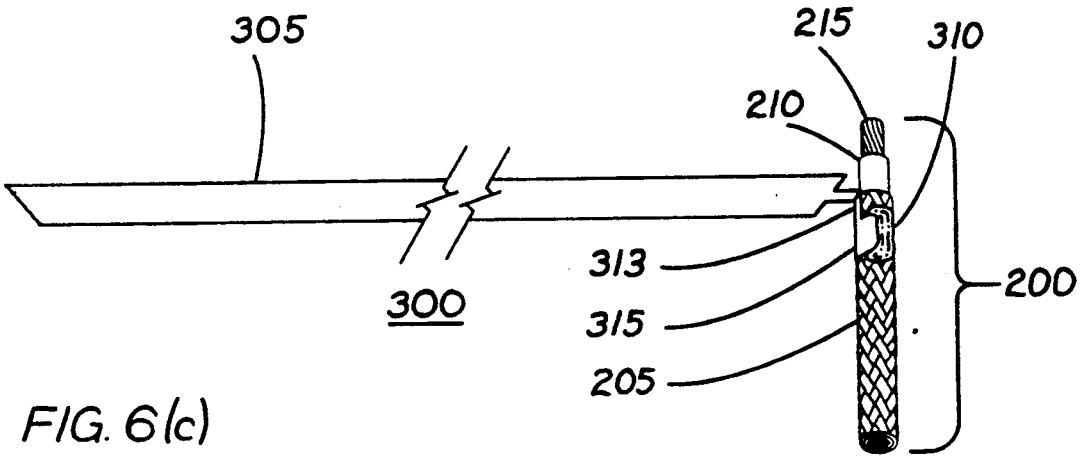
Figure 6D:
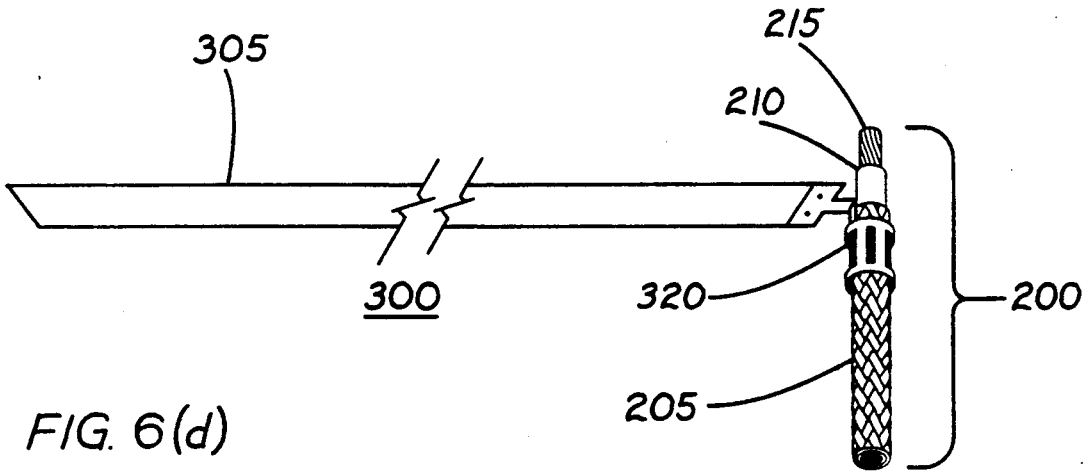
Figure 6E:
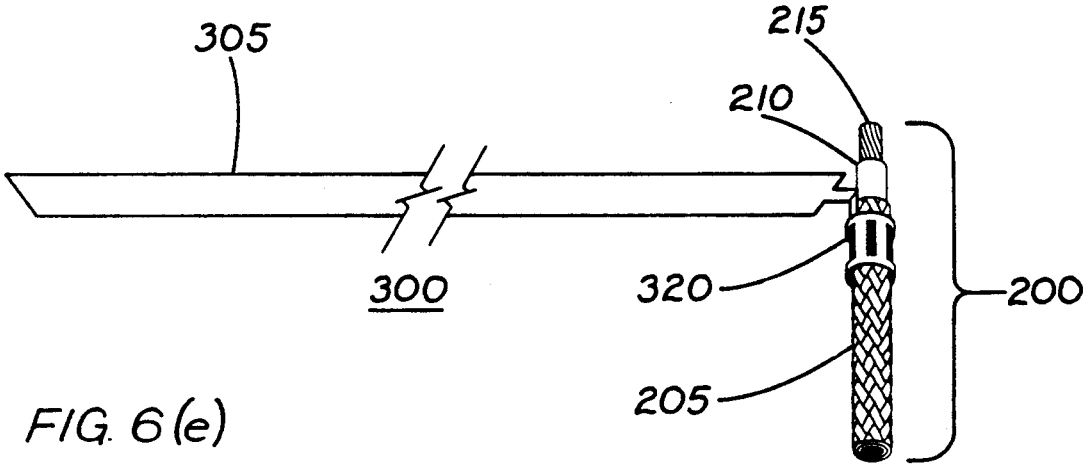
Figure 6F:
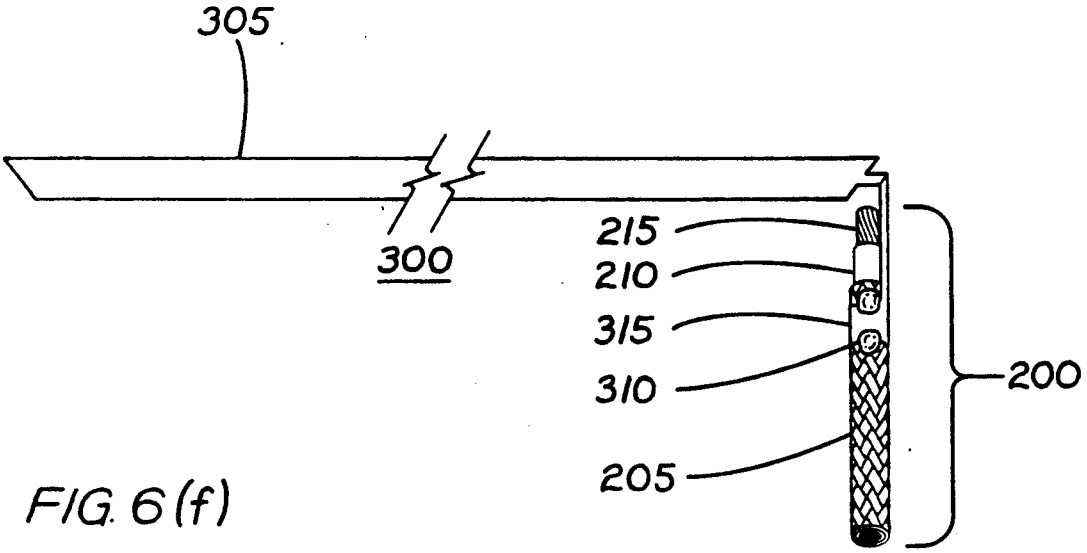

The assembly of output lead 200 and core 100 is shown in FIG. 5. Output lead 200 is a suitable length (usually about 15" (0.4 m)) of subminiature co-axial cable about 1/16" (1.6 mm) in diameter. Coaxial cable is required to prevent output lead 200 from picking up hum and other unwanted noise. Braid 205 and insulator 210 of output lead 200 are stripped back using known techniques to expose about 1/16" (1.6 mm) of inner conductor 215. Inner conductor 215, and, if it is to be soldered, braid 205, are prepared for soldering using well-known techniques. If output lead 200 is to be soldered to core 100 using normal temperature solder, as is preferred, this must be done before piezoelectric transducer element 400 (FIG. 7) is attached to core 100, otherwise the temperatures required to melt normal temperature solder will melt piezoelectric film 401. Alternatively, output lead 200 can be soldered to core 100 using a low-temperature (<90° C.) indiumtin solder. Inner conductor 215 is pushed through hole 120 and soldered using well-known techniques. Soldering may be carried out by hand after the printed circuit board has been cut into individual pieces, before core 100 is wrapped with piezoelectric transducer element 400, or, using low-temperature solder, after wrapping. Alternatively, output lead 200 may be soldered to core 100 by flow-soldering before the sheet of printed circuit board is cut into individual cores. Inner conductor 215 may also be attached to core 100 by electric welding.

When core 100 has the preferred lead anchor pad 138, output lead 200 is stripped through its braid 205 and inner insulator 210 to expose about 1/32" (0.8 mm) of inner conductor 215. When the lead has been stripped, no inner insulator 210 should be visible. Care must be taken to ensure that braid 205 is cut cleanly so that uncut strands of braid 205 do not come into contact with inner conductor 215. Exposed inner conductor 215 and braid 205 in the vicinity of exposed inner conductor 215 are then tinned. Inner conductor 215 is then inserted into plated-through hole 120 such that the tinned end of braid 205 comes into contact with lead anchor pad 138. Heat and solder are then applied to solder inner conductor 215 to hole 120 and heat is applied to sweat solder tinned braid 205 to tinned lead anchor pad 138. A cross section of the resulting assembly is shown in FIG. 5(*b*).

Irrespective of the method used to attach output lead 200 to core 100, care must be taken to ensure that inner conductor 215 and/or, for example, solder, does not protrude from the top of plated-through hole 120 to ensure that the bottom of saddle 63 contacts the top face of the pickup evenly along the whole of its length. The relative arrangement of core 100 and output lead 200 shown in FIG. 5(*a*) defines the upper and lower faces 130 and 135, respectively, of core 100. Output lead 200 extends from lower face 135.

Several alternative configurations of contact strip 300 are shown in FIG. 6. In some variations on the basic pickup design, including the preferred embodiment, contact strip 300 is mounted on the bottom (bridge side) of transducer 50; in other variations, contact strip 300 is mounted on the top (saddle side) of transducer 50. Contact strip 300 can be as simple as a rectangular piece of 0.002" (0.05 mm) thick foil 305 cut to the same width as the largest face 130 or 135 of core 100, i.e., about 1/16" (1.6 mm). Foil 305 is about the same length as core 100 if it is top mounted (FIG. 6(*f*)), and about 0.1" (2.5 mm) shorter than core 100, i.e., 2.4" (60 mm) if it is bottom mounted (FIG. 6(*a*)). When it is bottom-mounted, foil 305 must be shorter than core 100 so that it does not obstruct the access of output lead 200 to its connection point to core 100 at hole 120. Copper, brass, or some other suitable conductive material may be used for foil 305.

Output lead 200 can be attached to a bottom-mounted contact strip 300 in a number of different ways, some of which are shown in FIGS. 6(*a*) through 6(*e*). In the simplest configuration shown in FIG. 6(*a*), a hole is made in braid 205 of output lead 200 about ¼" (6 mm) from the end, and inner conductor 215 and insulator 210 are pulled through the hole. The resulting empty length of braid is twisted together, bent at right angles to the long axis of output lead 200, and soldered to the back of foil 305 by solder 310. If normal-temperature solder is to be used, this must be done before contact strip 300 is attached to piezoelectric film element 400, otherwise the soldering process can heat piezoelectric film element 400 to above its melting point. Before they are soldered, foil 305 and output lead 200 are preferably correctly positioned relative to one-another by means of a suitable jig (not shown). Alternatively, braid 205 can be soldered to the back of foil 305 after contact strip 300 has been attached to piezoelectric film element 400 if low-temperature (<90° C.) indium-tin solder is used.

This method of attaching braid 205 of output lead 200 to contact strip 300, although simple, is not favoured because it makes the bottom of the pickup uneven, which prevents the pickup from seating in the saddle-slot uniformly across its width.

Contact strip 300 can be extended over the full 2.5" length of the core by making a small hole 325 in foil 305, as shown in FIG. 6(*b*). Hole 325 needs only to be large enough to provide clearance for insulator 210 of output lead 200 to pass through it. The gap between contact strip 300 and braid 205 is then filled with solder.

An alternative way of attaching braid 205 of output lead 200 to contact strip 300 that is stronger than a simple soldered butt-joint is to extend the length of copper foil 305, as shown in FIG. 6(*c*). The end of contact strip extension 313 is formed to provide braid receptacle 315. Contact strip extension 313 is bent through 90° relative to foil 305, so that the long axis of receptacle 315 is at right-angles to the long axis of foil 305. Output lead 200 passes through receptacle 315, and braid 205 is soldered to receptacle 315 with normal or low-temperature solder 310, as discussed above. The diameter of the completed assembly is still small enough to pass through the hole made in the bottom of the saddle slot to accommodate the output lead.

A further way of attaching output lead 200 to contact strip 300, and of providing a reliable electrical and mechanical connection is shown in FIG. 6(*d*). Crimp receptacle 320 is attached to foil 305 by soldering, welding or some other way, and output lead 200 is crimped in crimp receptacle 320 using a suitable crimping tool. Crimp receptacle 320 can be made from beryllium copper but other materials well known in the art with suitable electrical and mechanical properties can be used. Alternatively, and preferred, since it gives the pickup a flat bottom to facilitate uniform seating in the saddle slot, as shown in FIG. 6(*e*), foil 305 and crimp receptacle 320 can be fabricated from a single piece of beryllium copper foil or other suitable material. Further advantages of crimping are that it (1) can be done as one of the last operations of the assembly process, which means that parts do not have to be pre-aligned, and (2) does not involve heating, which could melt piezoelectric transducer element 400 or otherwise distort the pickup.

The preferred embodiment uses a variation on the configuration shown in FIG. 6(*c*) with receptacle 315 omitted. Contact strip extension 313 is about ¼" (6.25 mm) long and 1/32" (0.8 mm) wide, and is bent through 90° relative to foil 305. Braid 205 of output lead 200 and contact strip extension 313 are tinned using techniques well known in the art, after which the two components are brought into contact and heat is applied to sweat solder them together.

The arrangements shown in FIGS. 6(*c*) through 6(*e*) can be adapted to provide soldered or crimped connections to output lead 200 from a top-mounted contact strip 300. For instance, a modification of the arrangement of FIG. 6(*c*) is shown in FIG. 6(*f*). Foil 305 is extended longitudinally to form contact strip extension 313. Contact strip extension 313 is bent through 90° so that it is at right angles to the main part of foil 305. The end of contact strip extension 313 is formed to provide receptacle 315 which conforms to the outer surface of output lead 200. Output lead 200 is inserted into receptacle 315 from the bottom as shown and is soldered in place with solder 310. Alternatively, receptacle 315 may be omitted and the plain end of contact strip extension 313 may be sweat soldered to braid 205 as previously described.

Figures 7A, 7B, 7C:
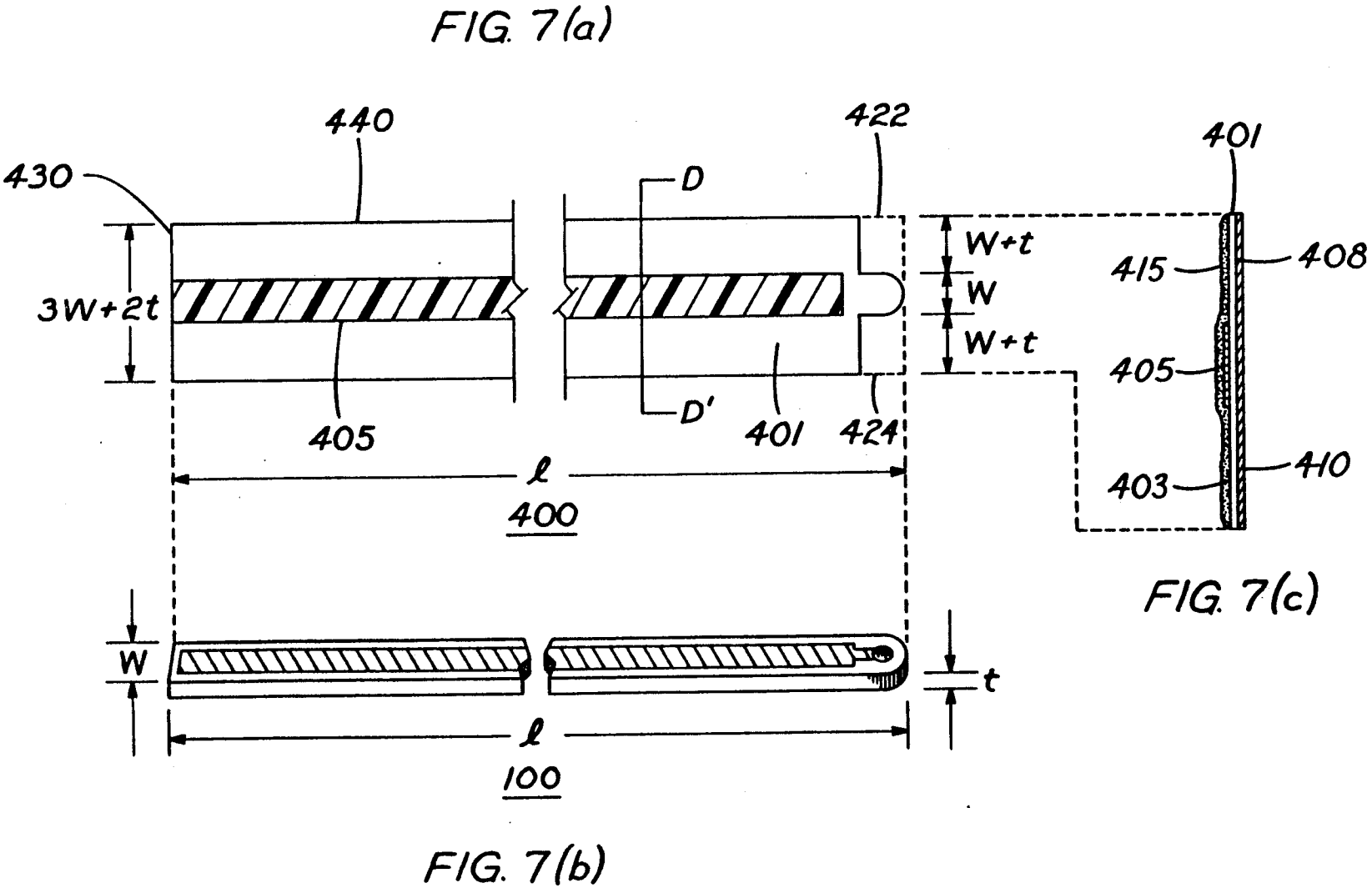
FIG. 7(*a*) shows a plan view of the piezoelectric transducer element, and the dimensional relationship between the piezoelectric transducer element and the core, which is shown in perspective view in FIG. 7(*b*).
Figure 8A:
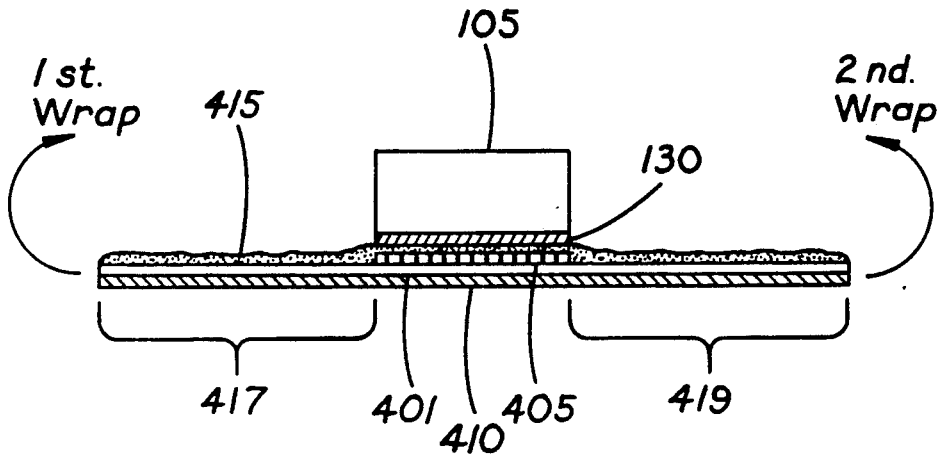
FIG. 8(*a*) is a cross-sectional view showing the initial assembly of the piezoelectric transducer element and the core, in which the piezoelectric transducer element is wrapped around the core in two wrapping operations.
Figure 8B:
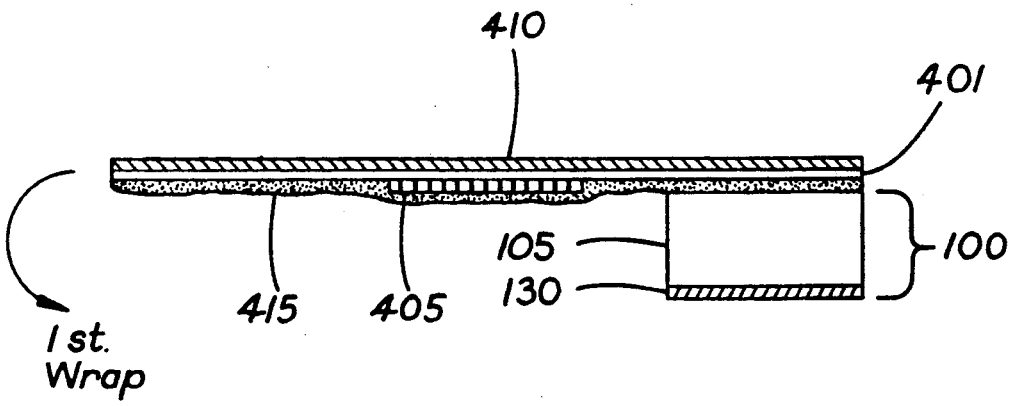
Figure 8C:
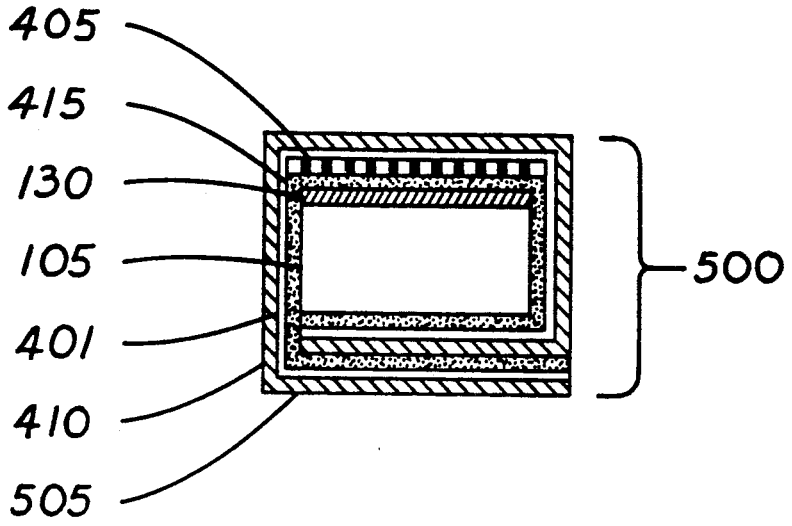
Figure 8D:
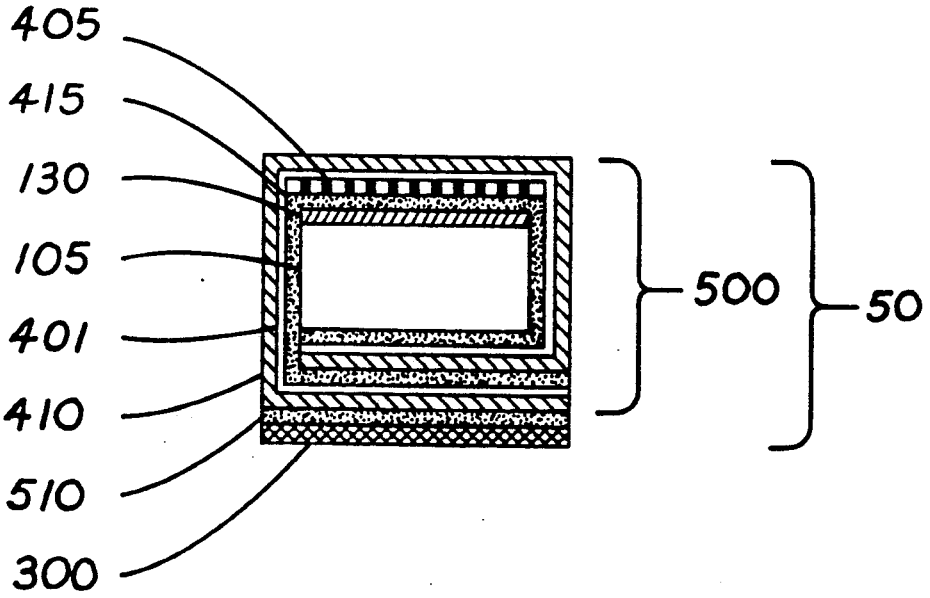
Figure 9A:
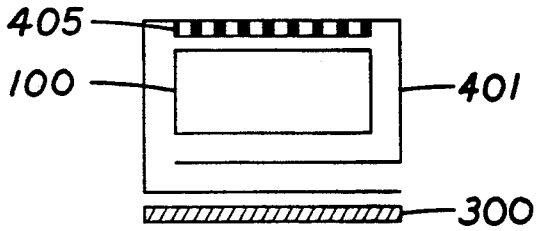
FIGS. 9(*a*) through 9(*f*) show schematic cross-sectional views of a number of variations on the basic piezoelectric transducer element, core and contact strip assembly.
Figure 9B:
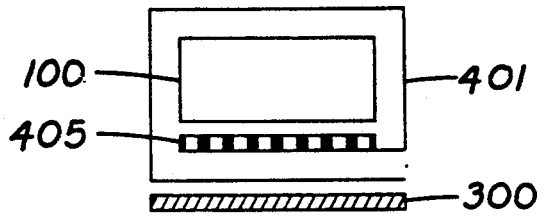
Figure 9C:
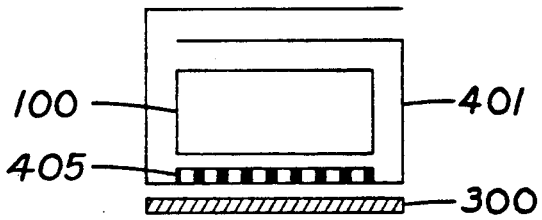
Figure 9D:
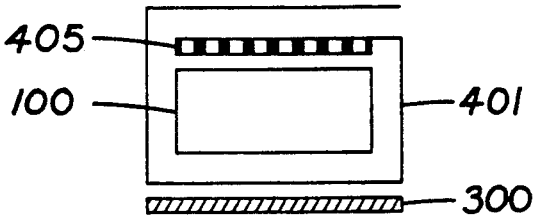
Figure 9E:
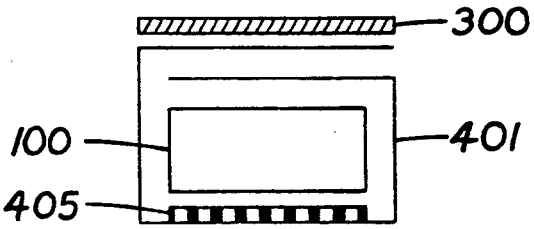
Figure 9F:
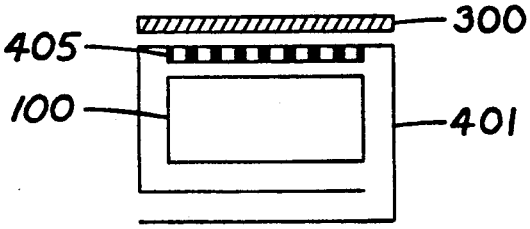
Figure 10A:
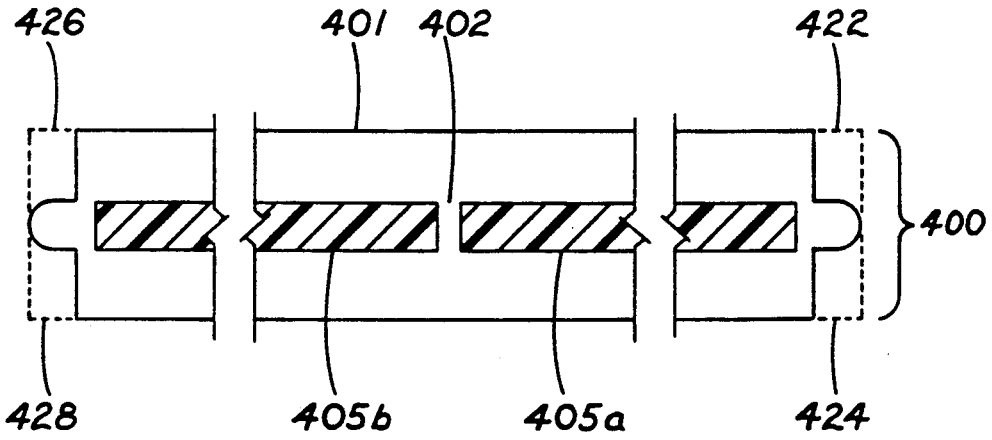
FIG. 10(*a*) shows a plan view of the first electrode side of the piezoelectric transducer element of a two output lead "stereo" version of the pickup according to the invention.
Figure 10B:
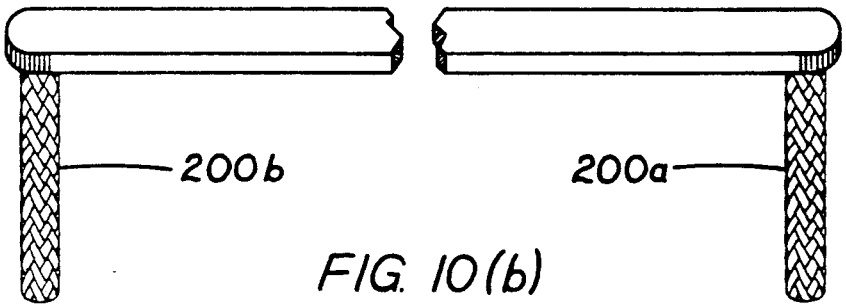
Figure 10C:
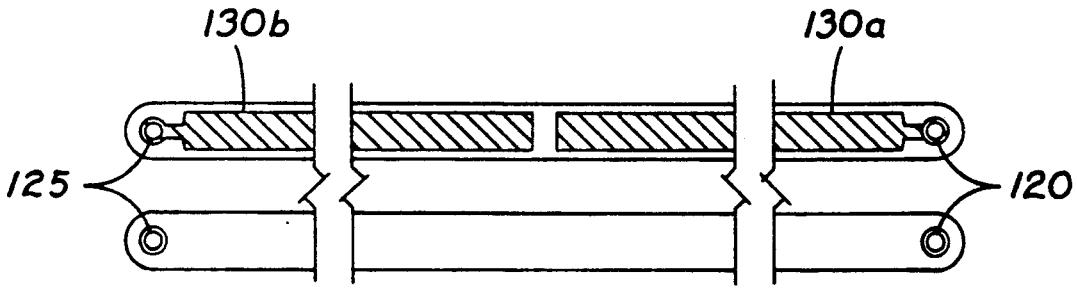
Figure 10D:
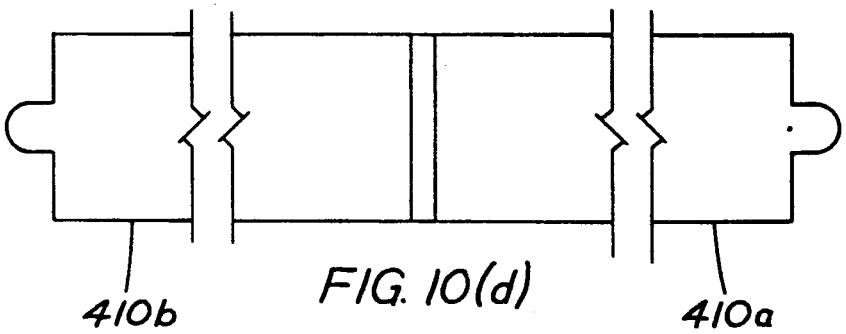

FIG. 7(*a*) shows piezoelectric transducer element 400, which is formed by depositing first and second metallized electrodes, 405 and 410 respectively, on an essentially rectangular piece of piezoelectric film 401. For this application, a PVDF film such as that sold under the trademark "KYNAR" by Atochem Sensors, Inc. is the preferred material for the piezoelectric film. A film thickness of 52 μm (about 0.002") gives the best compromise between output voltage and mechanical flexibility, and is thus preferred.

First electrode 405 is formed by partially covering the front side 403 of film 401 with a metallized layer, applied by painting with conductive paint, silk-screening with conductive ink, or vacuum depositing a metallic film. First electrode 405 is in the form of a strip, with its long axis parallel to the long axis of film 401. If the width of core 100 (FIG. 7(*b*) is W and the thickness of core 100 is t, in the preferred embodiment, the width of electrode 405 is about W and electrode 405 is located about W+t from one edge 440 of film 401, as shown in FIG. 7(*a*). In an alternative configuration of first electrode 405, the capacitance of the pickup is increased by increasing the width of electrode 405 to W+2t, the electrode being located about W from one edge 440 of film 401. Second electrode 410 is formed by covering all of the back side 408 of film 401 with a metallized layer, applied by any of the methods mentioned above.

A web of film is cut into individual films 401 by means of a knife, or, preferably, the web is die cut. The length of film 401 is the same as the length of core 100, but two approximately 0.1"×(W+t) (2.5 mm×(W+t) rebates 422 and 424 symmetrically disposed about electrode 405 are cut out from one end of film 401, as shown in FIG. 7(*a*). Rebates 422 and 424 enable piezoelectric transducer element 400, when it is wrapped around core 100, to cover all of core 100 except the small area in the vicinity of hole 120 at one end of lower face 135 of core 100 where the connection between core 100 and output lead 200 is made. This enables electrode 410 to provide as much electrical shielding of the connection between core 100 and output lead 200 as possible without obstructing the access of output lead 200 to core 100.

The sides and end of core 100 are exposed in the region where output lead 200 connects to core 100. Theoretically, electrode 410 could provide shielding to the sides and end of the core by extending electrode 410 and film 401 to cover such areas, but it has not been possible so far to find a way of reliably attaching such extended parts of film 401 to the sides and end of the core. Instead, the sides and end of the core are shielded by applying a conductive paint to the exposed surfaces of the core. The paint should also partially overlap electrode 410 to provide an electrical contact between the painted area and electrode 410.

The width of film 401 is sufficient to wrap around core 100 once with a complete overlap on longest face 130 or 135, i.e., approximately (3W+2t). If some wastage of film material can be afforded, the width of film 401 may be made greater than (3W+2t) to facilitate handling. Excess film material can be trimmed off towards the end of the assembly operation. If one or both ends of core 100 are rounded, piezoelectric transducer element 400 should have a matching rounded profile as shown in FIG. 7(*a*).

If electrodes 405 and 410 are applied by painting, the web of piezoelectric film must be cut into individual films 401 before the electrodes are applied. If the electrodes are applied by silk-screening or vacuum deposition, they can be applied before the web is cut into individual films 401. Cutting after silk-screening or vacuum deposition is possible because silk-screened or vacuum-deposited electrodes can be applied with sufficient precision to leave an un-metallized guard band in the region where the web is to be cut, which avoids the possibility of an electrical short between the electrodes at the cut edge.

If significant pick up from the back of the pickup is desired, a further first electrode (not shown) must be deposited on the same side of film 401 as electrode 405, and positioned so that it makes contact with face 135 (which must be conductive if pick up from the back is desired) of core 100. Simply gluing the film to a conductive face of core 100 with conductive glue does not produce a significant electrical output: the film must be metallized as described above.

Piezoelectric transducer element 400 is attached to core 100 by means of a conductive adhesive. Various kinds of adhesives based on acrylic, silicone, or urethane polymers can be used: in the preferred embodiment, a layer 415, about 0.001" to 0.002" (25 μm to 50 μm) thick, of type 9703 conductive adhesive, manufactured by 3M Corporation, is applied over all of the front side 403 of piezoelectric transducer element 400.

Preferably, core 100 is laid on adhesive layer 415 of piezoelectric transducer element 400 so that upper face 130 of core 100 is aligned with first electrode 405, as shown in FIG. 8(*a*). Piezoelectric transducer element 400 is laterally located on core 100 such that its edges are approximately flush with the ends of core 100. The two protruding pieces 417 and 419 of piezoelectric transducer element 400 are then wrapped around core 100 in two consecutive wrapping operations, ending up with two layers of film covering lower face 135.

Alternatively, piezoelectric transducer element 400 can be laid on core 100 as shown in FIG. 8(*b*), so that adhesive layer 415 is juxtaposed with lower face 135 of core 100, and edge 440 of piezoelectric transducer element 400 touches edge 140 of core 100. Piezoelectric transducer element 400 is laterally located on core 100 such that its edges are approximately flush with the ends of core 100. Piezoelectric transducer element 400 is then wrapped in a single wrapping operation all the way around core 100 such that it finally overlaps lower face 135 of core 100 again, i.e., lower face 135 is covered by two layers of film 401.

FIG. 8(*c*) shows a cross section of transducer 500 after piezoelectric transducer element 400 has been completely wrapped around core 100 by either method.

The preferred wrapping method is also preferred if single-sided printed circuit board is used for core 100. Alternatively, if a single wrapping operation is required, piezoelectric transducer element 400 can be wrapped starting on the non-copper side of the board, so that first electrode 405 contacts the copper side of core 100, or wrapping can start on the copper side of core 100 if first electrode 405 is relocated so that its outer edge is flush with edge 440 of piezoelectric transducer element 400.

All that now remains is to establish electrical contact between the second conductor (normally braid 205) of output lead 200 and second electrode 410 by attaching contact strip 300 to bottom 505 of core and piezoelectric transducer element assembly 500, i.e., to the face of assembly 500 from which output lead 200 emerges (or will emerge). Contact strip 300, which may or may not at this point of the assembly process already be attached output lead 200, is coated on the inner face of foil 305 with a layer 510 of conductive adhesive, such as type 9703 made by 3M Company, and placed in contact with bottom 505 of core and piezoelectric transducer element assembly 500. FIG. 8(*d*) shows a cross-sectional view of the completed transducer 50 with contact strip 300 glued in place.

If output lead 200 is not already connected to core 100 and/or contact strip 300, this can now be done to complete assembly of the pickup. Only attachment methods that do not run the risk of melting film 401 can be used if lead attachment is carried out at this stage of the assembly process, i.e., after transducer 50 is fully assembled.

Piezoelectric transducer element 400 is wrapped around core 100 such that first electrode 405 is in electrical contact with a conductive part of core 100, for example upper face 130. Since one conductor of output lead 200 is in electrical contact with a conductive part of core 100 (or will be in contact if output lead 200 is connected to core 100 after piezoelectric transducer element 400 is wrapped around core 100), this one conductor is in electrical contact with first electrode 405. Contact strip 300 is electrical contact with second electrode 410 of piezoelectric transducer element 400. Contact strip 300 is also in electrical contact with the other conductor of output lead 200. Thus, each conductor of output lead 200 makes electrical contact with one of the electrodes 405, 410 of piezoelectric transducer element 400, the contacts being made without exceeding the physical dimensions of transducer 50 (comprising the core, piezoelectric transducer element, and contact strip assembly) and output lead 200.

The completed pickup 60 is installed in the guitar by de-tensioning the strings and removing bridge saddle 63 (FIG. 3). Hole 65, approximately the same diameter as the width of the saddle slot (3/32" or approximately 2.4 mm), is drilled through bridge 70 and top 75 of the guitar at one end of saddle slot 68. About 1/16" (1.6 mm) of material is removed from the bottom of saddle 63, to reduce the height of saddle 63 by the thickness of transducer 50. Output lead 200 is passed through hole 65, and the pickup is installed so that transducer 50 lies at the bottom of saddle slot 68. Saddle 63 is then re-inserted in saddle slot 68, the strings are re-tensioned and the guitar re-tuned. Because the height of saddle 63 is reduced to compensate for the thickness of transducer 50 in the bottom of saddle slot 68, the distance from the top 75 of the guitar to the top of saddle 63 (and hence the height of strings 72 above top 75) is the same as it was before pickup 60 was installed.

FIG. 9 shows partially exploded cross sectional views of a number of possible variations on the locations of electrode 405 and contact strip 300 of transducer 50. In all of the variations, electrode 410 covers all the back side of film 401, and core 100 is oriented so that conductive face 130 is in contact with first electrode 405, so, for simplicity, these features are not shown in the drawings. Also, to simplify the drawings, film 401 is depicted as a single line, without thickness. Each variation produces a different "sound," so different applications and artistic preferences may favour one configuration over the others. FIG. 9(*a*) shows the arrangement described above, which, to the inventor, is the preferred embodiment of transducer 50. In variations (a), (d), and (f), electrode 405, and hence the transducing element, is closest to the strings, which reduces the amount of top noise produced by these variations. In variations (b), (c), and (e), electrode 405 is closest to the top of the guitar for those that prefer more top noise. In variations (a) through (d), contact strip is bottom mounted, which usually increases the coupling between the saddle and the transducer, and hence the efficiency of the pickup. However, because contact strip 300 is relatively soft, top mounting it, as in variations (e) and (f), can improve efficiency and string-to-string uniformity if, for example, the bottom of the saddle is uneven. In variations (b) and (d), electrode 405 is located beneath a double thickness of film 401.

Fabricating the variations is simply a matter of doing one or more of the following, and so will not be described in detail: (1) changing the location of electrode 405 on film 401, (2) placing electrode 405 in contact with top face 130 or bottom face 135 of core 100, and (3) top mounting or bottom mounting contact strip 300.

A further modification enables the basic construction technique described above to be adapted to make a "stereo" pickup, in which the three lower-frequency strings are represented by one electrical output signal and the three upper-frequency strings are represented by another electrical output signal. In such a pickup, electrode 405 of piezoelectric transducer element 400 is divided half-way along its length into two sub-electrodes, 405*a* and 405*b* as shown in FIG. 10(*a*). Double-sided printed circuit board is the strongly preferred material for core 100, because this material can be etched with lead patterns which facilitate connecting the sub-electrodes to the output lead(s).

The simplest form of stereo pickup, which uses two single-coaxial output leads, is shown in FIG. 10(*b*). In this pickup, piezoelectric transducer element 400 has rebates 422, 424, 426, and 428, about $0.1'' \times (W+t)$ 2.5 $mm \times (W+t)$) cut out of both ends to provide access to core 100 for two output leads. Sub-electrodes 405*a* and 405*b* are deposited on film 401 as already described.

Holes 120 and 125 are drilled in opposite ends of core 100 and plated through as previously described. A second lead anchor pad 139*b* (not shown) similar to lead anchor pad 138*a* (not shown) surrounding plated-through hole 120 preferably surrounds plated-through hole 125.

Conductive face 130 of core 100 is divided into two sub-faces, 130*a* and 130*b* by insulating area 140, half-way along the length of the face, as shown in FIG. 10(*c*). If pick up from the back of the pickup is not required, copper is removed as previously described from all of face 135, except for lead anchor pads 138*a* and 138*b*, and a small annulus around each of plated-through holes 120 and 125 to facilitate the plating through process.

If pick up from the back of the pickup is desired, conductive face 135 is divided into two sub-faces 135*a* and 135*b* (not shown) by insulating area 145 (not shown) about half-way along the length of the face. Sub-faces 135*a* and 135*b* must be isolated from lead anchor pads 138*a* and 138*b* if the latter are included. First and second sub-electrodes must be deposited on the same side of film 401 as first electrode 405, positioned so that they contact subfaces 135*a* and 135*b*.

Insulating areas 140 and 145 can be made by etching the copper of the printed-circuit board during the manufacturing process of the cores, or can be made by sawing through the copper, or by making parallel cuts in the copper and peeling off the copper between the cuts. Insulating area 140 and, optionally, 145 should be wider than gap 402 between sub-electrodes 405*a* and 405*b* on piezoelectric transducer element 400 to ensure that if, due to production tolerances or otherwise, piezoelectric transducer element 400 is placed in contact with core 100 slightly off-center, sub-electrodes 405*a* and 405*b* are not shorted together by contacting the same sub-face 130*a* or 130*b* of core 100.

Contact strip 300 is modified to provide on both ends whatever means was provided one end of the monophonic version of the pickup for contacting braid 205 of output lead 200.

Braid 205*a* of first output lead 200*a* is connected to one end of contact strip 300, and, in the preferred embodiment, is mechanically attached to lead anchor pad 138*a* on core 100, as previously described in connection with the single-channel version of the pickup. Inner conductor 215*a* of first output lead 200*a* is connected, via face 135*a* of core 100, to sub-electrode 405*a* of piezoelectric transducer element 100. Second output lead 200. Braid 205*b* of second output lead 200*b* is connected to the end of output strip 300 remote from output lead 200*a*, and, in the preferred embodiment, is mechanically attached to lead anchor pad 138*b*, as previously described in connection with the single-channel version of the pickup. Inner conductor 215*b* of output lead 200*b* is connected, via face 135*b* of core 100, to sub-electrode 405*b* of piezoelectric transducer element 400.

When this pickup is installed in the guitar, an additional 3/32" (2.4 mm) hole must be drilled at the end of bridge slot 68 remote from hole 65 to accommodate second output lead 200*b*. It can be seen that, depending on which way round the pickup is installed in the bridge slot of the guitar, the electrical signal on first output lead 200*a* will represent mainly the output from, say, the lower-frequency three strings, and the electrical signal from second output lead 200*b* will represent mainly the output from, say, the upper-frequency three strings, or vice versa.

If complete isolation between the output leads is desired, to avoid ground loops, for instance, the two sub-pickups may be completely isolated from one another by dividing second electrode 410 into two sub-electrodes 410*a* and 410*b*, as shown in FIG. 10(*d*), sub-electrodes 410*a* and 410*b* being on the other side of film 410 from sub-electrodes 405*a* and 405*b* respectively. Contact strip 300 is then also divided into two sub-contact strips 300*a* and 300*b* (not shown), contact strips 300*a* and 300*b* contacting sub-electrodes 410*a* and 410*b* respectively.

Figure 11A:
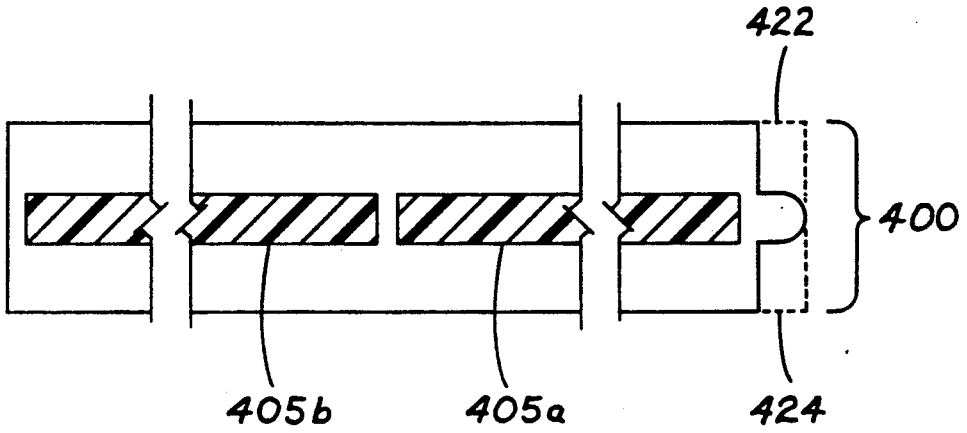
FIG. 11(*a*) shows a plan view of the first electrode side of the piezoelectric transducer element of a single output lead "stereo" version of the pickup according to the invention.
Figure 11B:
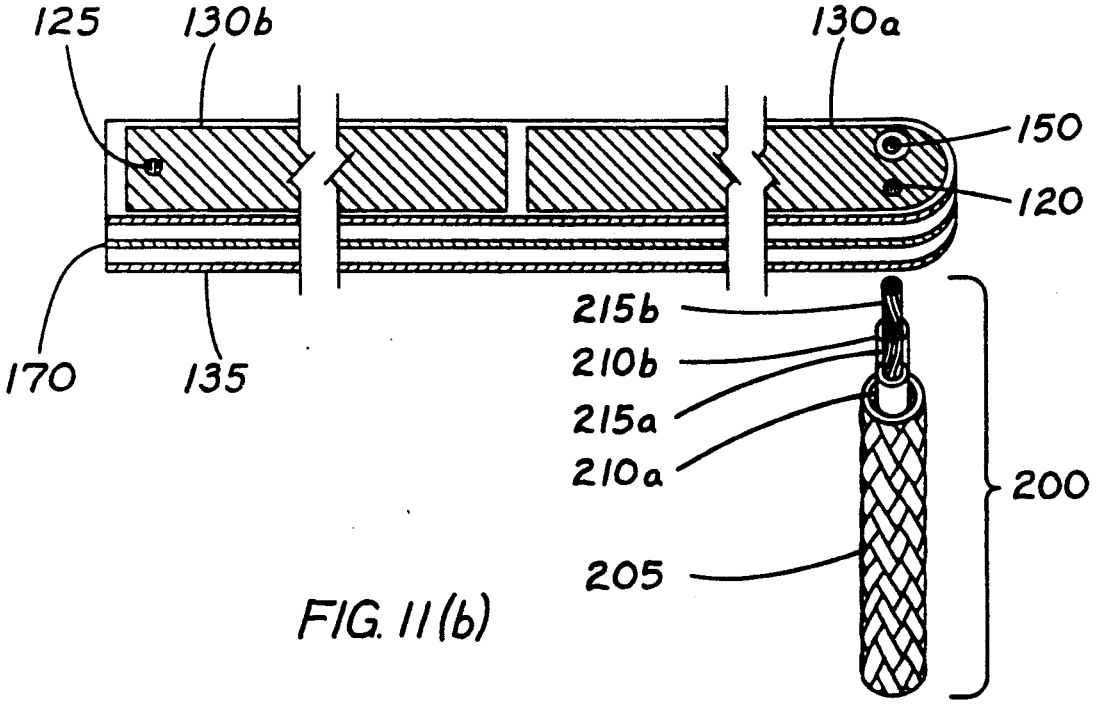
Figure 11:
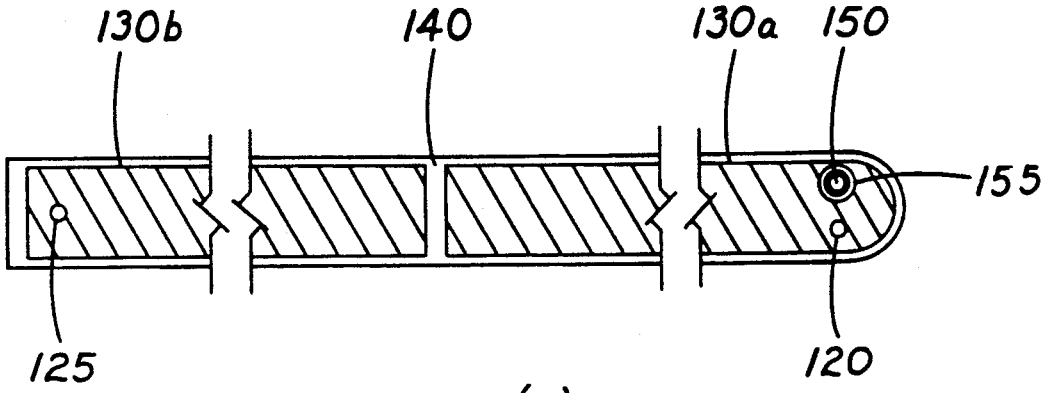
Figure 11:
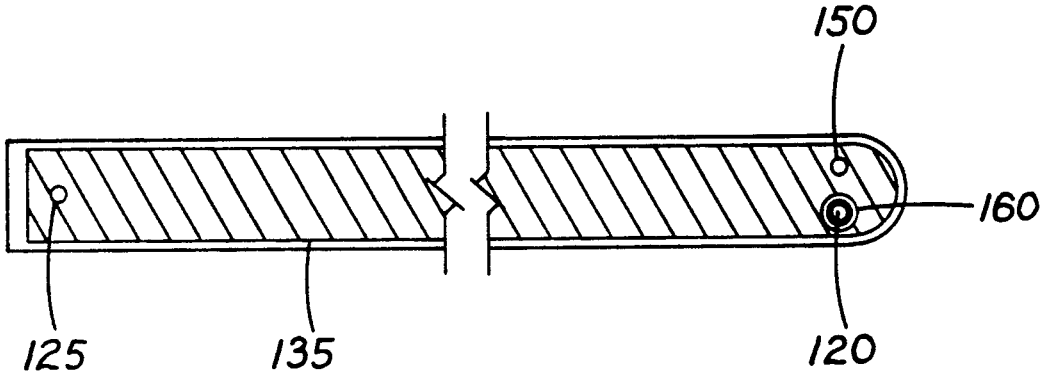
Figure 11:
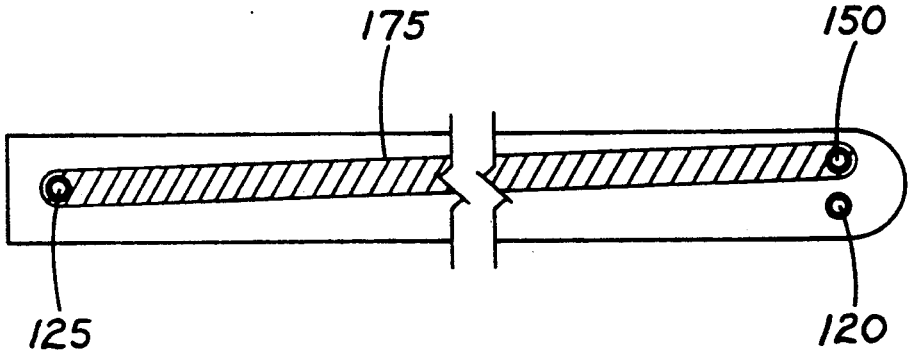
Figure 11F:
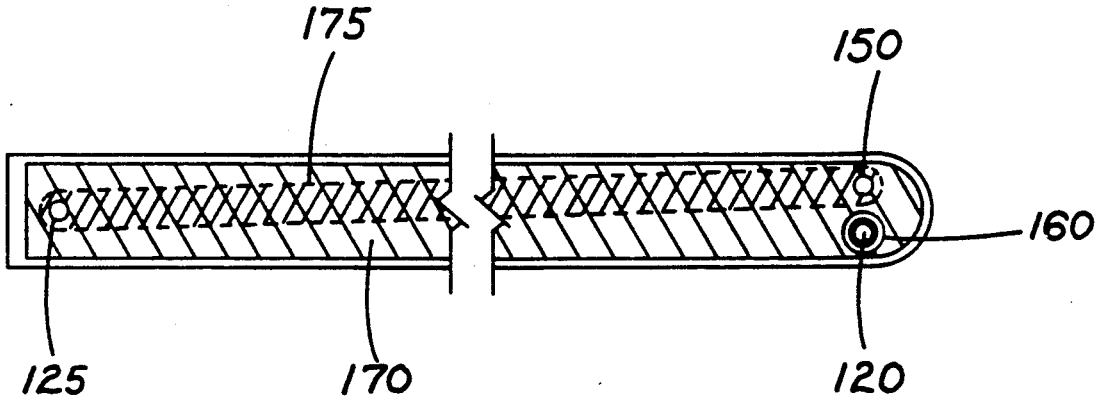
Figure 11G:
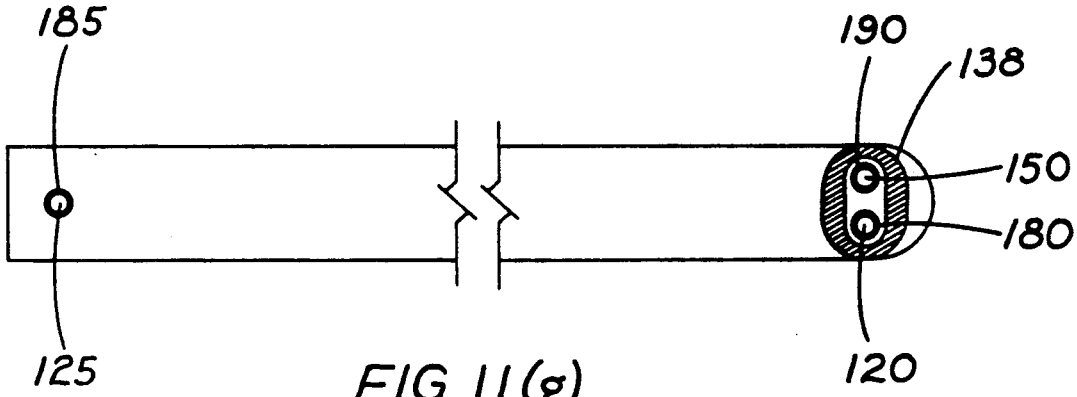
Figure 11H:
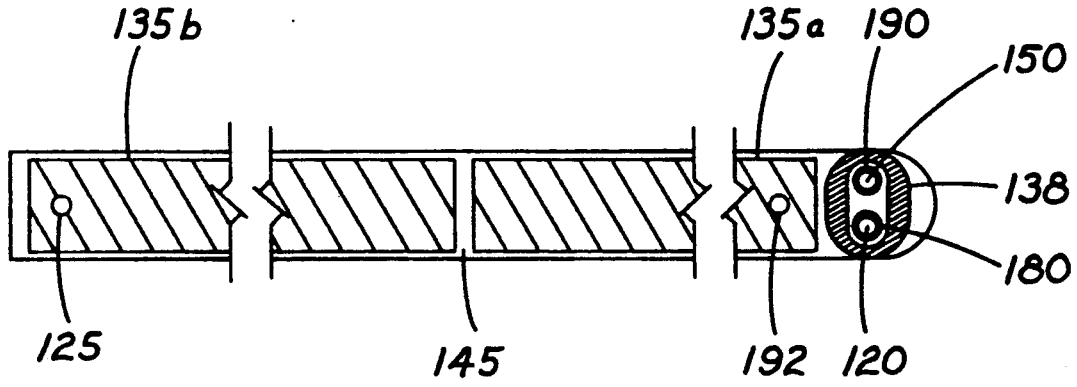

The inconvenience of having to drill a second hole in the bridge slot of the guitar to install a stereo pickup can be avoided by using a single subminiature twin shielded cable for output lead 200. Piezoelectric transducer element 400 for this pickup is shown in FIG. 11(*a*). Piezoelectric transducer element 400 has rebates 422 and 424 at only one end because there is only one output lead 200 to clear. The length of sub-electrodes 405*a* and 405*b* is reduced by about 0.1" (2.5 mm) compared with the twin-lead stereo pickup. The length of sub-electrode 405*a* is reduced to prevent it from making electrical contact with copper annulus 155 around plated-through hole 150. The length of sub-electrode 405*b* is reduced to make its electrical output equal to that of shortened electrode 405*a*.

Core 100 is more complex than the core of the mono or twin-lead stereo versions of the pickup: in addition to first plated-through hole 120 and additional plated-through hole 125, core 100 carries a third plated-through hole 150 at the same end of core 100 as plated-through hole 120, as shown in FIG. 11(*b*). Double-sided printed circuit board can be used for core 100. To connect the two sub-electrodes 405*a* and 405*b* of piezoelectric transducer element 400 to the two inner conductors of output lead 200, copper is selectively removed from the two copper-clad faces of the printed circuit board. Copper removal is preferably done by a masking and etching process carried out before the printed circuit board is cut up into individual cores. A strip of copper 140 is removed from upper face 130, as shown in FIG. 11(*c*), to divide face 130 into sub-faces 130*a* and 130*b* and an annulus or other suitable area of copper 155 surrounding plated-through hole 150 is removed to isolate plated-through hole 150 from sub-face 130*a*. Copper on lower face 135 serves as a conductive track to conduct the signal picked up by sub-face 130*b*, and connected to lower face 135 by plated-through hole 125, to plated-through hole 150 and thence to the second conductor 215*b* of output lead 200. An annulus or other suitable area of copper 160 surrounding plated-through hole 120 is removed from lower face 135, as shown in FIG. 11(*d*), to electrically isolate face 135 from plated-through hole 120.

It can be seen that face 130*a* is connected directly to plated-through hole 120, and face 130*b* is connected via plated-through hole 125 and the conductive track provided by face 135 to plated-through hole 150; and that plated-through hole 120 is electrically isolated from plated-through hole 150.

Piezoelectric transducer element 400 is metallized with two sub-electrodes 405*a* and 405*b* as shown in FIG. 11(*a*), and is wrapped around core 100 as previously described, so that electrode 405*a* is in electrical contact with sub-face 130*a* and electrode 405*b* is in electrical contact with sub-face 130*b*. Thus, the output of electrode 405*a* appears at plated-through hole 120, and the output of electrode 405*b* appears at plated-through hole 150.

Because lower face 135 is attached to the plastic surface of film 401 of piezoelectric transducer element 400 with conductive adhesive, and is therefore in electrical contact with it, it might be thought that lower face 135 would pick up sufficient charge from film 401 to give rise to crosstalk problems. Measurements show that the amount of pick up by lower face 135 is relatively insignificant, however. Film 401 would have to be metallized in the region in which it contacts lower face 135 for there to be a significant amount of pick up by lower face 135.

If it is desired to eliminate completely the small amount of pick up from film 401 by face 135, a piece of thin insulating plastic, such as Mylar ®, or other suitable insulating material, the same width as, and about 0.2" (5 mm) shorter than, face 135 can be attached symmetrically to face 135. The insulator prevents electrical contact between film 401 and face 135, and hence prevents face 135 from picking up unwanted electrical signals from piezoelectric transducer element 400. Alternatively, the small amount of unwanted pickup by face 135 can also be reduced without adding an insulating layer by removing copper from face 135 so that plated-through holes 125 and 150 are interconnected by narrow track of copper 175, as shown in FIG. 11(*e*).

Using two-layer printed circuit board for core 100 of a single output lead stereo pickup does not conveniently allow the braid of output lead 200 to be mechanically attached to the core. While attaching the braid of output lead 200 to core 100 by partially surrounding holes 120 and 150 with a lead anchor pad is not impossible, there is an appreciable risk of a short circuit between braid 205 and narrow track 175 in the region where these two elements are juxtaposed. By using a three-layer printed-circuit board for core 100, braid 205 of output lead 200 can be mechanically attached to the core. Additionally, using three-layer board allows the small amount of unwanted pickup by face 135 to be completely eliminated without having to use a separate insulator between film 401 and face 135.

Parts of the copper layer forming the upper face 130, lower face 135, and middle layer 170 of the printed-circuit board are removed to form connections and lead patterns as shown in FIG. 11(*c*), 11(*f*), and 11(*g*). A strip of copper 140 is removed from top face 130, as shown in FIG. 11(*c*), to divide it into two sub-faces 130*a* and 130*b*, as in the twin-lead version shown in FIG. 11. An annulus or other suitable area of copper 155 surrounding plated-through hole 150 is removed, preferably by etching, to isolate plated-through hole 150 from sub-face 130*a*.

Conductive middle layer 170 serves as conductive track to conduct the signal picked up by sub-face 130*b*, and connected to middle layer 170 by plated-through hole 125, to plated-through hole 150 and thence to the second conductor 215*a* of output lead 200. An annulus or other suitable area 160 of copper middle layer 170 surrounding plated-through hole 120 is removed, preferably by etching, to electrically isolate plated-through hole 120 from middle layer 170, as shown in FIG. 11(*f*). Additionally, if it is desired to reduce the capacitance between sub-face 130*a* and middle layer 170, additional copper may be removed from middle layer 170 so that plated-through holes 125 and 150 are interconnected by a narrow track of copper 175, instead of the whole of middle layer 170.

Copper is almost completely removed, preferably by etching, from lower face 135, leaving only isolated copper annuli 180, 185 and 190 surrounding plated-through holes 120, 125 and 150 respectively, as shown in FIG. 11(*g*). These annuli are required to facilitate plating, and, in the case of holes 120 and 150, to facilitate soldering the inner conductors of output lead 200 to these holes. Surrounding holes 120 and 150 is lead anchor pad 138. The centers of holes 120 and 150 are spaced by a distance equal to the spacing between the centers of the inner conductors of output lead 200. The radiussed parts of lead anchor pad 138 are spaced from the centers of the respective holes 120 and 150 by an amount equal to the outer radius of the inner insulator 210*a* or 210*b* of output lead 200. The inner conductors 215*a* and 215*b* of output lead 200 are soldered to holes 120 and 150 respectively and braid 205 is sweat soldered to lead anchor pad 138 as previously described.

It can be seen that face 130*a* is connected directly to plated-through hole 120, and face 130*b* is connected via plated-through hole 125 and the conductive track provided by middle layer 170 (or by narrow track 175) to plated-through hole 150; that plated-through hole 120 is electrically isolated from plated-through hole 150, and that lead anchor pad 138 is electrically isolated from both of plated-through holes 120 and 150.

A three-layer core enables pickup by face 135 to be used to increase the output voltage and to increase the capacitance of the single-lead stereo pickup without impairing stereo separation. Lower face 135 is divided into two sub-faces 135*a* and 135*b* by removing, preferably by etching, a narrow strip of copper 145 as shown in FIG. 11(*h*). Sub-face 135*a* is connected to sub-face 130*a* by a fourth plated-through hole 192. There is no connection to fourth plated-through hole 192 on middle layer 170. Plated-through holes 120 and 150 are surrounded by copper annuli 180 and 190 respectively to facilitate plating through and to facilitate soldering the inner conductors of output lead 200 to these holes. Surrounding holes 120 and 150 is lead anchor pad 138, which is isolated from sub-face 135*a*. The centers of holes 120 and 150 are spaced by a distance equal to the spacing between the centers of the inner conductors of output lead 200. The radiussed parts of lead anchor pad 138 are spaced from the centers of the respective holes 120 and 150 by an amount equal to the outer radius of the inner insulator 210*a* or 210*b* of output lead 200. The inner conductors 215*a* and 215*b* of output lead 200 are soldered to holes 120 and 150 respectively and braid 205 is sweat soldered to lead anchor pad 138 as previously described.

An additional pair of sub-electrodes is deposited on film 401 of piezoelectric transducer element 400, positioned so that they make contact with sub-faces 135*a* and 135*b*. It can be seen that plated-through hole 192 connects sub-face 135*a* to sub-face 130*a*, and thence to plated-through hole 120; that plated-through hole 125 connects sub-face 130*b* and sub-face 135*b* to one another and to layer 170 (or track 175), which connects them to plated-through hole 150; and that plated-through hole 120 is electrically isolated from plated-through hole 150, and that plated through holes 120 and 150 are electrically isolated from lead anchor pad 138.

The following remarks regarding further aspects of the single output lead stereophonic pickup apply irrespective of which configuration of core 100 and piezoelectric transducer element 400 described above is used. A subminiature coaxial cable with twin inner conductors 215*a* and 215*b* is used for output lead 200. First inner conductor 215*a* of output lead 200 is attached to plated-through hole 120, and second inner conductor 215*b* of output lead 200 is attached to plated-through hole 150, as shown in FIG. 11(*b*). Soldering is the preferred method of attaching inner conductors 215*a* and 215*b* of output lead 200 to core 100, although other methods, well known in the art, can be used. If lead attachment takes place after piezoelectric transducer element 400 is wrapped around core 100, the attachment process must not involve temperatures that would melt or distort piezoelectric transducer element 400. The options for the configuration of contact strip 300 are the same as in the basic pickup. Apart from the modifications to core 100, output lead 200, and piezoelectric transducer element 400 described above, the construction and assembly of the single lead stereophonic pickup are the same as the construction and assembly of the basic pickup, and with therefore not be described.

Although the above description describes a "stereo" pickup with two symmetrical outputs, each output of the pickup representing the output from three strings, the basic techniques described can be used in asymmetrical pickups, in which one of the outputs reproduces the output from fewer than three strings, and in multichannel pickups, in which first electrode 405 of piezoelectric transducer element 400 and face 130 of core 100 are divided into a plurality of sub-electrodes and subfaces, respectively, and a multiple conductor output lead is used.

Figure 12:
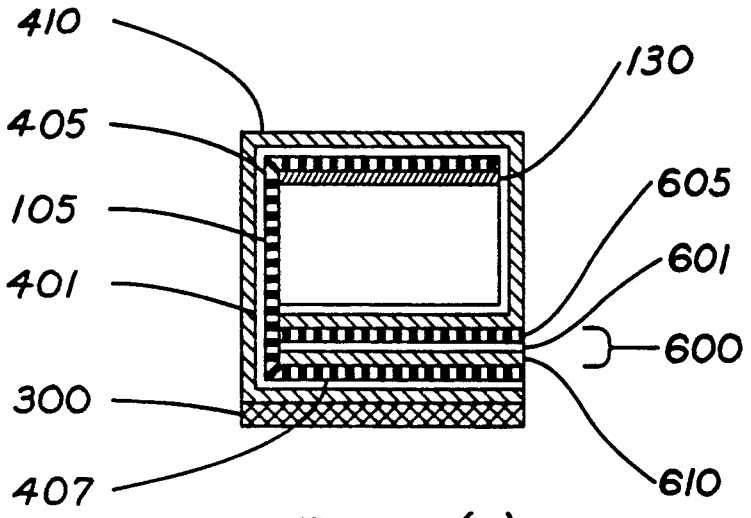
FIG. 12(*a*) shows a cross-sectional view of a pickup including an auxiliary transducer for reducing top noise.
Figure 12:
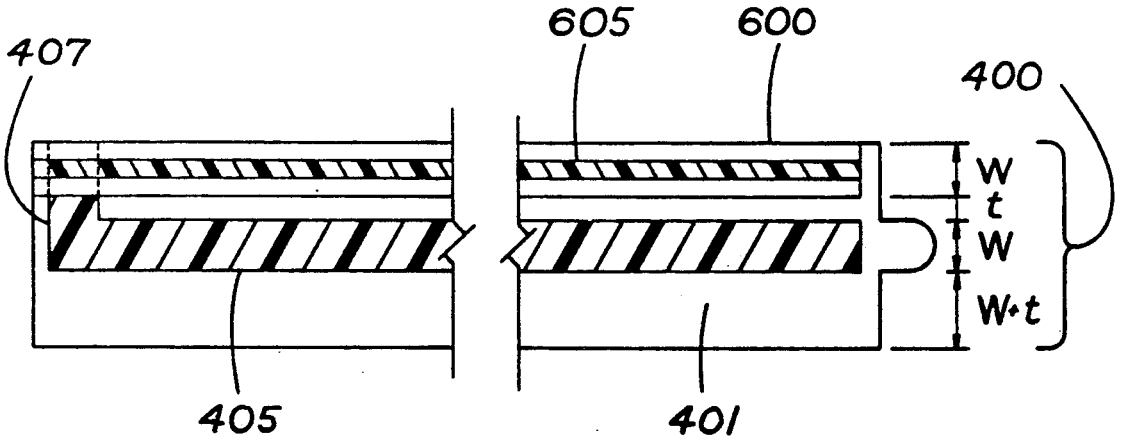

The basic pickups described above pick up an appreciable amount of top noise due to the application of top noise generated forces to the lower face of the pickup. Top noise can be reduced by building into the pickup a auxiliary transducer sensitive to top noise and combining the outputs of the main and auxiliary transducers. A cross-sectional view of the top-noise reducing pickup is shown in FIG. 12(*a*). Unlike the cross-sectional view of the basic pickup shown in FIG. 8(*d*), FIG. 12(*a*) does not show conductive adhesive layer 415. This layer has been deliberately omitted to simplify the drawing.

Auxiliary piezoelectric transducer element 600 comprises a piece 601 of the same piezoelectric film as piezoelectric transducer element 400, with about the same width as core 100 and about the same length as piezoelectric transducer element 400. Alternatively, a different piezoelectric plastic material and/or a different thickness of the same material can be used. Piezoelectric film 601 is metallized on both sides, using one of the techniques described above for metallizing piezoelectric transducer element 400, to form electrodes 605 and 610. Electrode 610 covers all of one side of film 601; electrode 605 partially covers the other side of film 601. The electrical output of auxiliary piezoelectric transducer element 600 relative to piezoelectric transducer element 400 is determined by the relative areas of electrode 605 of auxiliary piezoelectric transducer element 600 and electrode 405 of piezoelectric transducer element 400 (assuming the same thickness of the same piezoelectric material is used).

Electrode 405 of piezoelectric transducer element 400 is enlarged to add at least one auxiliary contact area 407. The width of film 401 is increased slightly (by approximately the thickness of auxiliary piezoelectric transducer element 600) to account for the extra thickness around which piezoelectric transducer element 400 must be wrapped.

Assembly of the pickup is as described above, except that, preferably, auxiliary piezoelectric transducer element 600 is pre-attached to piezoelectric transducer element 400 before piezoelectric transducer element 400 is wrapped around core 100. Conductive adhesive is preferably used to attach auxiliary piezoelectric transducer element 600 to piezoelectric transducer element 400. Auxiliary piezoelectric transducer element 600 is positioned relative to piezoelectric transducer element 400 as shown in FIG. 12(*b*), so that electrode 610 of auxiliary piezoelectric transducer element 600 is in electrical contact with auxiliary contact area 407 of electrode 405 of piezoelectric transducer element 400. The combined piezoelectric transducer element is then wrapped around core 100 by either the double-wrap or single-wrap methods already described.

Alternatively, core 100 can be applied to piezoelectric transducer element 400, and first protruding piece 417 of piezoelectric transducer element 400 wrapped around core 100, as before. Then, auxiliary piezoelectric transducer element 600 with a layer of conductive adhesive applied to electrode 605 can be placed on the back (i.e., on electrode 410) of first protruding piece 417 of piezoelectric transducer element 400. Finally, second protruding piece 419 of piezoelectric transducer element 400 can be wrapped around core 100, as before, enveloping auxiliary piezoelectric transducer element 600. Alternatively protruding piece 419 may be wrapped first, auxiliary piezoelectric transducer element 600 applied to the back of it, and then protruding piece 419 may be wrapped.

At the end of any of the described wrapping operations, auxiliary piezoelectric transducer element 600 is sandwiched within piezoelectric transducer element 400 as shown in FIG. 12(*a*).

It can be seen that auxiliary piezoelectric transducer element 600 and piezoelectric transducer element 400 are connected in parallel but are arranged so that the output of auxiliary piezoelectric transducer element 600 opposes the output of piezoelectric transducer element 400. Piezoelectric transducer element 400 is on the saddle side of pickup 60, so picks up more strongly from the strings than from the top; auxiliary piezoelectric transducer element 600 is on the bridge side of pickup 60, so picks up more strongly from the top than from the strings. The connection of the two transducer elements in opposition reduces both the wanted output from the strings and the unwanted output from the top, but, because auxiliary piezoelectric transducer element 600 is smaller than piezoelectric transducer element 400 and is closer to the top, top noise can be substantially reduced while retaining a useful output from the strings. The optimum ratio of areas of the two transducer elements depends on the guitar in which the pickup is installed, and on artistic preferences as to the amount of top noise reduction required.

Further variations on the pickups described herein can be applied to any stringed instrument, such as a violin, in which a string passes over a bridge (or a saddle forming part of a bridge), and which allows a suitably-shaped pickup to be inserted between the saddle and the bridge or between the bridge and the top of the instrument.

I claim:

1. An electro-mechanical pickup for a musical instrument, comprising:

an elongated multi-faced core having an electrically conducting face, a piezoelectric transducer element comprising a piezoelectric film including a first surface and a second surface opposite the first surface, a first electrode covering at least part of the first surface, and a second electrode covering at least part of the second surface, the piezoelectric transducer element covering substantially all of the electrically conducting face of the core, and being attached to the core with the first electrode in contact with the electrically conducting face of the core, a contact strip in contact with at least part of the second electrode, and an output lead, having a first conductor and a second conductor, the first conductor being connected to the electrically conducting face of the core, and the second conductor being connected to the contact strip.

2. The pickup of claim 1 wherein the core comprises an elongated insulating layer disposed between a first conducting layer and a second conducting layer, the first conducting layer and the second conducting layer each at least partially covering the insulating layer, the first conducting layer providing the electrically conducting face of the core, and a plated-through hole connecting the first conducting layer to at least part of the second conducting layer, and the plated-through hole connects the first conductor of the output lead to the first conducting layer.

3. The pickup of claims 1 or 2 wherein the first electrode is divided into a plurality of sub-electrodes, the electrically conducting face of the core is divided into a plurality of conducting sub-faces, each sub-face corresponding to a sub-electrode, one of the conducting sub-faces contacts the first conductor of the output lead, and the other conducting sub-faces each contact a further output conductor.

4. The pickup of claim 3 wherein the first electrode is divided into two sub-electrodes, the electrically conducting face of the core is divided into a first conducting sub-face and a second conducting subface, and there is one further output conductor, the further output conductor being the first conductor of a second output lead having first and second conductors, the first conductor of the second output lead being connected to the second conducting sub-face of the core, and the second conductor of the second output lead being connected to the contact strip.

5. The pickup of claim 3 wherein the first electrode is divided into two sub-electrodes, the electrically conducting face of the core is divided into a first conducting sub-face and a second conducting sub-face, there is one further output conductor, the further output conductor being a third conductor of the output lead, the core further includes a conducting track, the second sub-face is connected to the conducting track, and the third conductor of the output lead is connected to the conducting track.

6. The pickup of claim 2 wherein the second conducting layer includes an electrically-isolated lead anchor pad substantially surrounding the plated-through hole, and the second conductor of the output lead is additionally attached to the lead anchor pad.

7. The pickup of claims 1, 2, or 6 wherein the first electrode is attached to the electrically conducting face of the core by means of a conductive adhesive, and the contact strip is attached to the second electrode by means of a conductive adhesive.

8. An electro-mechanical pickup for a musical instrument, comprising:

an elongated multi-faced core having an electrically conducting face, a piezoelectric transducer element comprising a piezoelectric film including a first and a second surface opposite the first surface, a first electrode covering at least part of the first surface, and a second electrode covering substantially all of the second surface, the piezoelectric transducer element covering substantially all the electrically conducting face of the core, and being wrapped around the core and adapting itself generally to the shape of the core with the first electrode in contact with the electrically conducting face of the core and the second electrode providing an electrical shield around the core, the piezoelectric film and the first electrode, a contact strip in contact with at least part of the second electrode, and an output lead, having a first conductor and a second conductor, the first conductor being connected to the electrically conducting face of the core, and the second conductor being connected to the contact strip.

9. The pickup of claim 8 wherein the length and width of the first electrode of the piezoelectric transducer element are substantially similar to the length and width of the electrically conducting face of the core.

10. The pickup of claim 8 wherein the length of the first electrode of the piezoelectric transducer element is substantially similar to the length of the electrically conducting face of the core, and the width of the first electrode of the piezoelectric transducer element is substantially equal to the sum of the width and twice the thickness of the core.

11. The pickup of claims 8, 9, or 10 wherein the first electrode is divided into a plurality of sub-electrodes, the electrically conducting face of the core is divided into a plurality of conducting sub-faces, each sub-face corresponding to a sub-electrode, one of the conducting sub-faces contacts the first conductor of the output lead, and the other conducting sub-faces each contact a further output conductor.

12. The pickup of claim 11 wherein the first electrode is divided into two sub-electrodes, the electrically conducting face of the core is divided into a first conducting sub-face and a second conducting subface, and there is one further output conductor, the further output conductor being the first conductor of a second output lead having a first conductor and a second conductor, the first conductor of the second output lead being connected to the second sub-face of the core, and the second conductor of the second output lead being connected to the contact strip.

13. The pickup of claim 12 wherein the core comprises an elongated insulating layer disposed between a first conducting layer and a second conducting layer, the first conducting layer providing the electrically conducting face of the core, and a plated-through hole connecting the first conducting layer to at least part of the second conducting layer, and the plated-through hole connects the first conductor of the output lead to first conducting layer.

14. The pickup of claim 12 wherein the second conductor of each output lead is additionally attached to a lead anchoring pad on the core, each lead anchoring pad being electrically isolated from the core.

15. The pickup of claim 11 wherein the first electrode is divided into two sub-electrodes, the electrically conducting face of the core is divided into a first conducting sub-face and a second conducting subface, there is one further output conductor, the further output conductor being a third conductor of the output lead, the core further includes a conducting track, the second sub-face is connected to the conducting track, and the third conductor of the output lead is connected to the conducting track.

16. The pickup of claim 15 wherein the core comprises an elongated insulating layer disposed between a first conducting layer and a second conducting layer the first conducting layer providing the electrically conducting face of the core, the second conducting layer providing the conducting track, a non-conducting strip across the width of the first conducting layer dividing the first conducting layer to provide the first conducting subface and the second conducting sub-face, a first plated-through hole connected to the first conducting sub-face and electrically isolated from the conducting track, a second plated-through hole connected to the conducting track and electrically isolated from the first conducting sub-face, and a third plated-through hole connecting the second conducting sub-face to the conducting track, the first plated-through hole connects the first conductor of the output lead to the first conducting sub-face, and the second plated-through hole connects the third conductor of the output lead to the conducting track.

17. The pickup of claim 16 wherein the second conductor of the output lead is additionally attached to a lead anchoring pad on the core, the lead anchoring pad being electrically isolated from the core.

18. The pickup of claim 16 wherein the core further comprises a second elongated insulating layer disposed between the second conducting layer and a third conducting layer, the third conducting layer at least partially covering the second insulating layer, the third conducting layer comprises a small conducting area surrounding each plated-through hole, and an electrically-isolated lead anchor pad substantially surrounding the first and second plated-through holes, and the third conductor of the output lead is additionally attached to the lead anchor pad.

19. The pickup of claim 16 wherein the core further comprises a second elongated insulating layer disposed between the second conducting layer and a third conducting layer, the third conducting layer at least partially covering the second insulating layer, the third conducting layer further comprises a small conducting area surrounding each plated-through hole, an electrically-isolated lead anchor pad substantially surrounding the first and second plated-through holes, a third conducting sub-face, and a fourth conducting sub-face, the third plated-through hole connects the second conducting sub-face to the fourth conducting sub-face and to the track, and a fourth plated-through hole connects the first conducting sub-face to the third conducting sub-face and is isolated from the track, the third conductor of the output lead is additionally attached to the lead anchor pad, and the piezoelectric transducer element includes a additional first electrode, laterally spaced from the first electrode such that it contacts the third conducting layer when the piezoelectric transducer element is wrapped around the core, the additional first electrode being divided into two sub-electrodes.

20. The pickup of claim 16 wherein the first conducting layer covers substantially all the insulating layer, and the second conducting layer covers substantially all the insulating layer.

21. The pickup of claim 8 wherein the core comprises an elongated insulating layer disposed between a first conducting layer and a second conducting layer, the first conducting layer providing the electrically conducting face of the core, and a plated-through hole connecting the first conducting layer to at least part of the second conducting layer, and the plated-through hole connects the first conductor of the output lead to first conducting layer.

22. The pickup of claim 21 wherein the length and width of the first electrode of the piezoelectric transducer element are substantially similar to the length and width of the electrically conducting face of the core.

23. The pickup of claim 21 wherein the length of the first electrode of the piezoelectric transducer element is substantially similar to the length of the electrically conducting face of the core, and the width of the first electrode of the piezoelectric transducer element is substantially equal to the sum of the width and twice the thickness of the core.

24. The pickup of claims 9, 10, 22, or 23 wherein the piezoelectric transducer element is rebated, the rebated areas providing access to the core when the piezoelectric transducer element is wrapped around the core.

25. The pickup of claim 21 wherein the first conducting layer covers substantially all the insulating layer, and the second conducting layer covers substantially all the insulating layer.

26. The pickup of claim 21 wherein the second conducting layer includes an electrically-isolated lead anchor pad substantially surrounding the plated-through hole, and the second conductor of the output lead is additionally attached to the lead anchor pad.

27. The pickup of claims 8, 9, 10, 21, or 26 wherein the contact strip comprises a conductive foil, the length of foil being slightly shorter than the length of the core, and the width of foil being substantially similar to the width of the core.

28. The pickup of claim 8, 9, 10, 21, or 26 wherein the first electrode is attached to the electrically conducting face of the core by means of a conductive adhesive, the piezoelectric transducer element is secured in its wrapped state by means of an adhesive, and the contact strip is attached to the second electrode by means of a conductive adhesive.

29. The pickup of claims 8, 9, 10, 21, or 26 further comprising an auxiliary piezoelectric transducer element comprising a piezoelectric film having a first surface and a second surface opposite the first surface, a first auxiliary electrode covering part of the first surface, and a second auxiliary electrode covering substantially all of the second surface, the auxiliary piezoelectric transducer element being in contact with the piezoelectric transducer element and being wrapped around the core with the piezoelectric transducer element.

30. The pickup of claim 29 wherein the first electrode of the piezoelectric transducer element includes an auxiliary contact area, the second auxiliary electrode of the auxiliary piezoelectric transducer element is in contact with the auxiliary contact area, and the first auxiliary electrode of the auxiliary piezoelectric transducer element is in contact with the second electrode of the piezoelectric transducer element.

31. The pickup of claim 29 wherein the area of the first auxiliary electrode of the auxiliary piezoelectric transducer element is smaller than the area of the first electrode of the piezoelectric transducer element.

32. The pickup of claim 26 wherein the length and width of the first electrode of the piezoelectric transducer element are substantially similar to the length and width of the electrically conducting face of the core.

33. The pickup of claim 26 wherein the length of the first electrode of the piezoelectric transducer element is substantially similar to the length of the electrically conducting face of the core, and the width of the first electrode of the piezoelectric transducer element is substantially equal to the sum of the width and twice the thickness of the core.

34. The pickup of claim 8 wherein the second electrode of the piezoelectric transducer element provides an electrical shield for the ends of the core.

35. A stringed musical instrument, comprising:

a bridge having a saddle slot, a saddle in the saddle slot, a plurality of strings, each string contacting the top of the saddle, an electro-mechanical pickup in the saddle slot, the electro-mechanical pickup having substantially the same width and length as the width and length of the saddle slot, and having at least two surfaces, one surface being in contact with the bottom of the saddle, the other surface being in contact with the bottom of the saddle slot, the electro-mechanical pickup comprising:

an elongated multi-faced core having an electrically conducting face, a piezoelectric transducer element comprising a piezoelectric film including a first surface and a second surface opposite the first surface, a first electrode covering at least part of the first surface, a second electrode covering at least part of the second surface, the piezoelectric transducer element covering substantially all of the electrically conducting face of the core, and being attached to the core such that the first electrode is in contact with the electrically conducting face of the core, a contact strip in contact with at least part of the second electrode, and an output lead having a first conductor and a second conductor, the first conductor being connected to the electrically conducting face of the core, and the second conductor being connected to the contact strip, and a hole in the bottom of the saddle slot for receiving the output lead, the diameter of the hole being no greater than the width of the saddle-slot.

36. The stringed musical instrument of claim 35 wherein the second electrode covers substantially all of the second surface of the piezoelectric film, and the piezoelectric transducer element is wrapped around the core and adapts itself generally to the shape of the core, the second electrode providing an electrical shield around the core, the piezoelectric film and the first electrode.

* * * * *